US011059689B2

(12) United States Patent
Takemura et al.

(10) Patent No.: US 11,059,689 B2
(45) Date of Patent: Jul. 13, 2021

(54) SHEET STORING APPARATUS AND SHEET STORING METHOD

(71) Applicant: GLORY LTD., Hyogo (JP)

(72) Inventors: Yoichi Takemura, Hyogo (JP); Tomohiro Yokoo, Hyogo (JP)

(73) Assignee: GLORY LTD., Hyogo (JP)

( * ) Notice: Subject to any disclaimer, the term of this patent is extended or adjusted under 35 U.S.C. 154(b) by 76 days.

(21) Appl. No.: 16/249,263

(22) Filed: Jan. 16, 2019

(65) Prior Publication Data

US 2019/0218052 A1 Jul. 18, 2019

(30) Foreign Application Priority Data

Jan. 18, 2018 (JP) ..... JP2018-006367

(51) Int. Cl.

| | |
|---|---|
| ***B65H 31/00*** | (2006.01) |
| ***B65H 29/46*** | (2006.01) |
| ***G07D 11/12*** | (2019.01) |
| ***G07D 11/34*** | (2019.01) |
| ***B65H 31/02*** | (2006.01) |
| ***G07D 11/18*** | (2019.01) |
| ***B65H 31/30*** | (2006.01) |
| *B65B 25/14* | (2006.01) |
| *B65B 63/02* | (2006.01) |

(52) U.S. Cl.

CPC ..... *B65H 29/46* (2013.01); *B65H 31/00* (2013.01); *B65H 31/02* (2013.01); *B65H 31/3018* (2013.01); *G07D 11/12* (2019.01); *G07D 11/18* (2019.01); *G07D 11/34* (2019.01); *B65B 25/14* (2013.01); *B65B 63/02* (2013.01); *B65H 2301/4212* (2013.01); *B65H 2301/422544* (2013.01); *B65H 2301/422548* (2013.01); *B65H 2701/1912* (2013.01)

(58) Field of Classification Search

CPC .... B65H 31/10; B65H 31/3045; B65H 43/06; B65H 29/34; G07D 11/23

See application file for complete search history.

(56) References Cited

U.S. PATENT DOCUMENTS

| | | | | |
|---|---|---|---|---|
| 5,676,366 | A | 10/1997 | Polidoro | |
| 7,451,977 | B2 * | 11/2008 | Gabel | B65H 29/46 109/22 |
| 9,266,693 | B2 * | 2/2016 | Hashimoto | B65H 31/22 |
| 2015/0097332 | A1 | 4/2015 | Duchstein | |
| 2016/0031574 | A1 * | 2/2016 | Razzaboni | B65B 7/02 53/268 |
| 2018/0029730 | A1 | 2/2018 | Yokoo et al. | |

FOREIGN PATENT DOCUMENTS

| | | | |
|---|---|---|---|
| EP | 2860139 | A1 | 4/2015 |
| EP | 3473555 | A1 | 4/2019 |
| GB | 0742014 | A | 12/1955 |
| WO | WO2016/136517 | | 9/2016 |

OTHER PUBLICATIONS

Extended European Search Report, European Patent Office, European Patent Application No. 19152457.8, dated Jun. 14, 2019.

* cited by examiner

*Primary Examiner* — Howard J Sanders

(74) *Attorney, Agent, or Firm* — Greenblum & Bernstein, P.L.C.

(57) ABSTRACT

A sheet storing apparatus includes: a compression section that performs first compression and second compression by applying a pressing force to sheets stored in a bag; and a control section that controls the pressing force.

15 Claims, 21 Drawing Sheets

SHEET STORING APPARATUS AND SHEET STORING METHOD

CROSS REFERENCE TO RELATED APPLICATIONS

The entire disclosure of Japanese patent Application No. 2018-006367, filed on Jan. 18, 2018, is incorporated herein by reference in its entirety.

TECHNICAL FIELD

The present invention relates to a sheet storing apparatus that stores sheets in a bag and a sheet storing method.

BACKGROUND ART

Conventionally, sheet storing apparatuses that store sheets in a storing bag, for example a pouch bag, have been used. For example, Patent Literature 1 discloses a banknote storing apparatus that stores banknotes, which are one kind of sheet. In the banknote storing apparatus disclosed in Patent Literature 1, an opening of a storing bag with banknotes stored therein is closed by heating members.

CITATION LIST

Patent Literature

PTL 1
WO 2016/136517

SUMMARY OF INVENTION

Technical Problem

However, when the opening of the bag is closed, if a sheet, such as a banknote, is stuck in the opening of the bag, the bag may defectively be sealed.

The present invention has been made in view of such circumstances above and an object of the present invention is to provide a technique that prevents defective sealing of a bag.

Solution to Problem

A sheet storing apparatus according to the present invention comprises: a compression section that performs first compression and second compression by applying a pressing force to sheets stored in a bag; and a control section that controls the pressing force.

A sheet storing method according to the present invention comprises: performing first compression by applying a first pressing force to sheets stored in a bag; and performing second compression by applying a second pressing force to the sheets.

Advantageous Effects of Invention

The present invention enables provision of a technique that prevents defective sealing of a bag.

DESCRIPTION OF EMBODIMENTS

As an embodiment of a sheet storing apparatus of the present invention, a banknote storing apparatus that stores banknotes will be described below.

Figure 1:
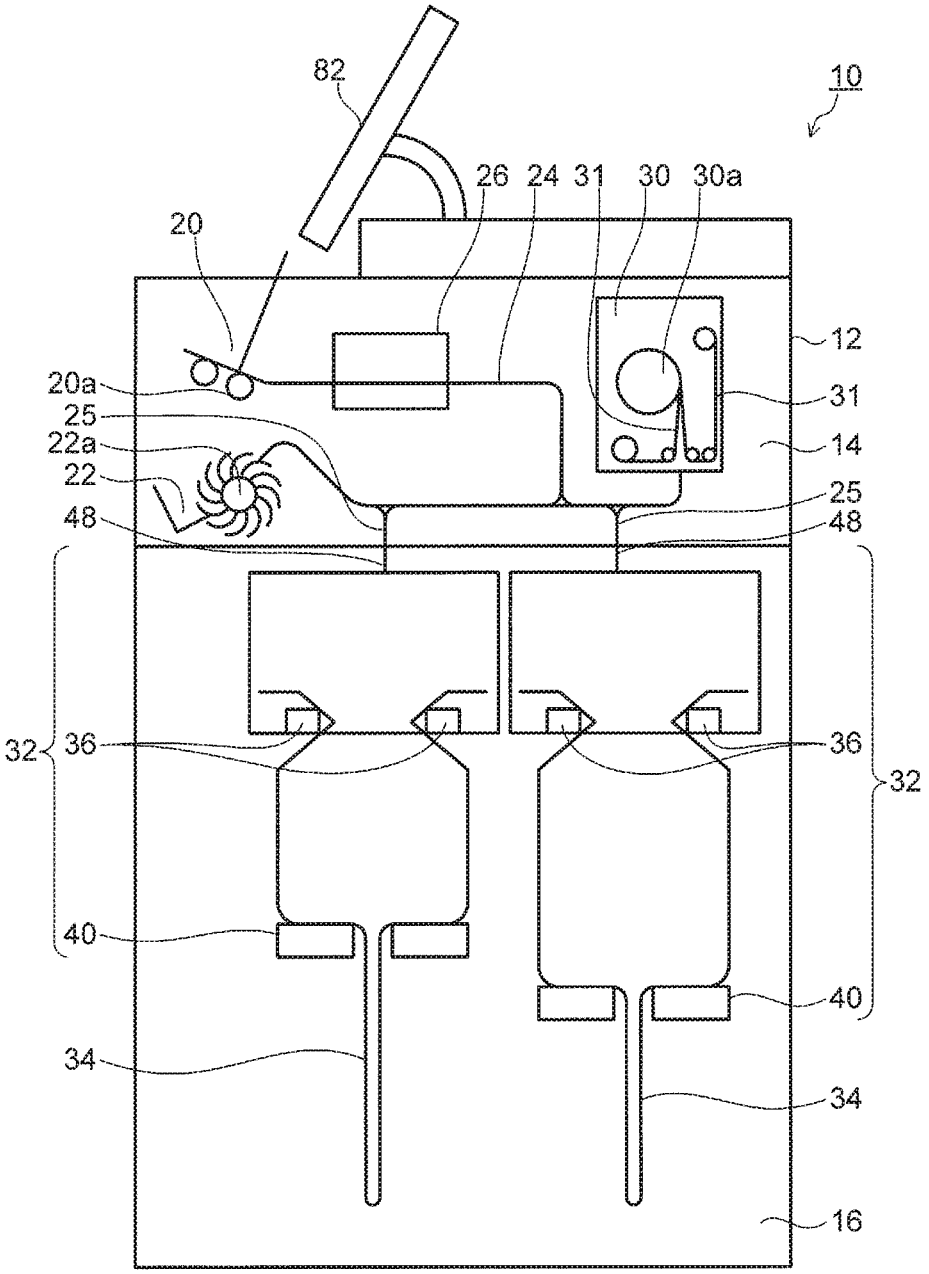
FIG. 1 is a schematic diagram of a banknote storing apparatus according to an embodiment.

FIG. 1 is a schematic diagram illustrating a banknote storing apparatus 10 according to one embodiment. The banknote storing apparatus 10 is to be generally disposed in a front office area or a back office area of a shop, such as a supermarket or a bank. The banknote storing apparatus 10 is configured so as to be capable of performing various kinds of processing such as banknote deposit processing. Here, the left side of FIG. 1 is the front side of the banknote storing apparatus 10, that is, the side that an operator of the banknote storing apparatus 10 faces, and the right side of FIG. 1 is the rear side of the banknote storing apparatus 10.

The banknote storing apparatus 10 comprises a substantially rectangular parallelepiped casing 12. Inside the casing 12, an upper unit 14 and a lower unit 16 are housed in such a manner that the upper unit 14 and the lower unit 16 can be each pulled forward from a front surface of the casing 12.

Inside the upper unit 14, more specifically, in an upper front portion of the casing 12, an inlet 20, which is formed of a receiving hopper and like, for putting banknotes into the inside from the outside of the casing 12 is provided. In the inlet 20, a banknote feeding mechanism 20*a* that feeds banknotes placed in a stacked state in the inlet 20 one by one into the casing 12 is provided.

Inside the upper unit 14, a transport unit 24 that transports banknotes one by one is provided. The banknotes fed from the inlet 20 by the banknote feeding mechanism 20*a* are transported one by one by the transport unit 24.

Inside the upper unit 14, more specifically, in the vicinity of the transport unit 24, a recognition unit 26 is provided. The recognition unit 26 recognizes a denomination, authenticity, a face/back, fitness, new series/old series, a transport state, and/or the like of each banknote transported by the transport unit 24.

Inside the upper unit 14, more specifically, below the inlet 20 in the front surface of the casing 12 (surface on the left side in FIG. 1), an outlet 22 for discharging banknotes from the inside of the casing 12 to the outside is provided. The transport unit 24 is connected to the outlet 22.

The outlet 22 comprises a stacking wheel 22*a*. The stacking wheel 22*a* rotates counterclockwise in the state illustrated in FIG. 1, that is, in a right side view. Therefore, each of banknotes transported to the outlet 22 by the transport unit 24 is rotated and moved together with the stacking wheel 22*a* in such a manner that the banknote is held between two vanes included in the stacking wheel 22*a* and the banknotes are thereby stacked in an aligned state in the outlet 22. The outlet 22 is accessible from the outside of the casing 12 and the operator can take out the banknotes stacked in the outlet 22 from the front surface of the casing 12.

Inside the upper unit 14, a tape-type storing/feeding unit 30 is provided. The storing/feeding unit 30 is connected to the transport unit 24. Banknotes transported to the storing/feeding unit 30 by the transport unit 24 are stored in the storing/feeding unit 30. Also, the storing/feeding unit 30 can feed out stored banknotes one by one to the transport unit 24. In detail, the storing/feeding unit 30 comprises a drum 30*a* that can rotate in both forward and reverse directions. One end of each of a pair of band-like tapes 31 is connected to an outer circumferential surface of the drum 30*a*. Banknotes transported to the storing/feeding unit 30 by the transport unit 24 are wound up one by one together with the tapes 31 by the drum 30*a*. On the other hand, upon the drum 30*a* being rotated in the reverse direction and the pair of tapes 31 being rewound from the drum 30*a*, banknotes wound up on the drum 30*a* can be fed out to the transport unit 24.

Also, inside the upper unit 14, two diverged transport units 25 diverge from the transport unit 24 so as to correspond to later-described respective banknote storing mechanisms 32. Banknotes transported from the transport unit 24 to each diverged transport unit 25 are fed to a banknote storing bag 34 mounted in the relevant banknote storing mechanism 32 and stored inside the banknote storing bag 34.

An operation/display unit 82 is attached to the front side of an upper portion of the upper unit 14, more specifically, on the front side of an upper portion of the casing 12. The operation/display unit 82 is, for example, a touch panel. On the operation/display unit 82, a processing status of banknote deposit processing in the banknote storing apparatus 10 or information relating to an inventory amount of banknotes stored in each banknote storing bag 34 are displayed. Also, the operator can provide various instructions to a control section 80 (see FIG. 10) by operating the operation/display unit 82.

Two banknote storing mechanisms 32 are provided in the lower unit 16. Here, it should be understood that: the number of banknote storing mechanisms 32 is not limited to two and may be one or three or more. Each banknote storing mechanism 32 comprises a banknote feeding section 48, a pair of holding members 36, and stages 40.

Figure 2:
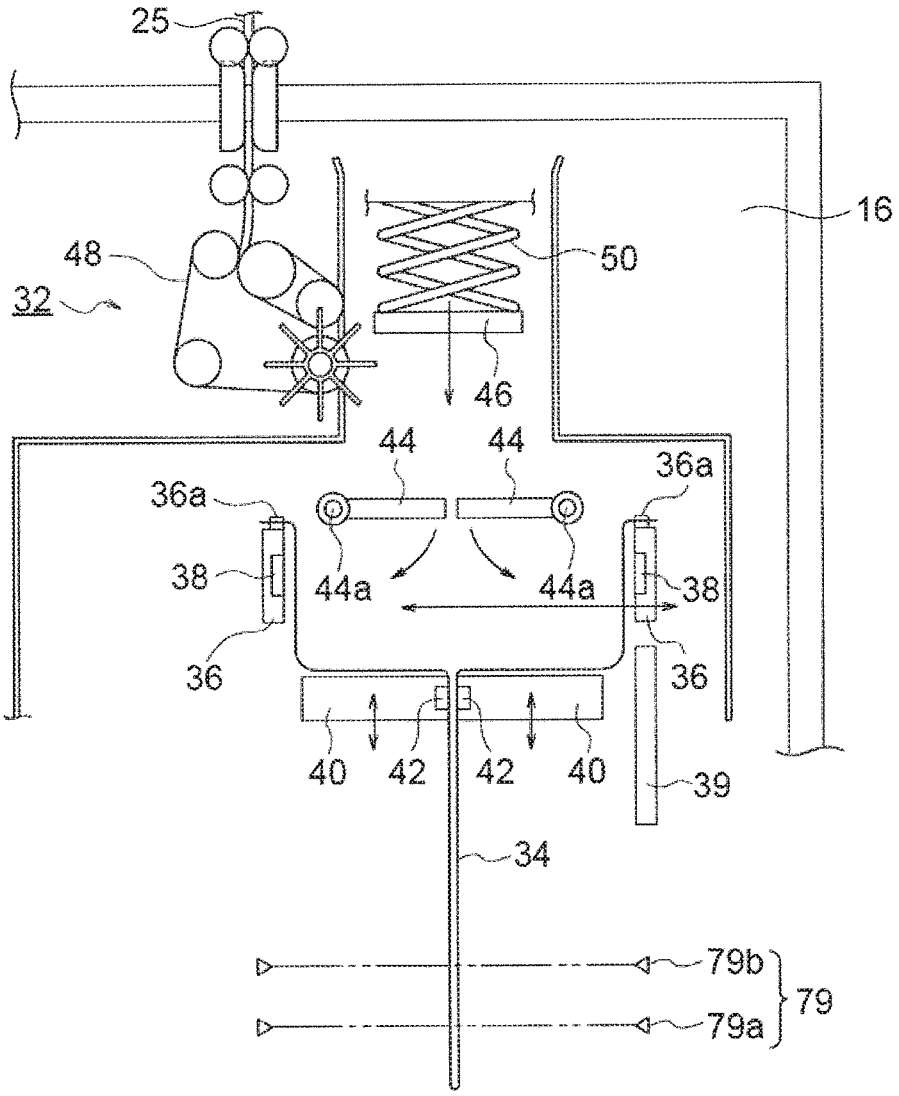
FIG. 2 is a right side view of a banknote storing mechanism.

FIG. 2 is a right side view of a banknote storing mechanism 32. Each banknote storing mechanism 32 comprises a pair of holding members 36. The paired holding members 36 face each other and are spaced a predetermined distance from each other. The pair of holding members 36 hold respective parts of a banknote storing bag 34, the parts being located at the vicinity of an opening portion of the banknote storing bag 34 and facing each other.

A position of one (for example, the rear-side holding member 36) of the pair of holding members 36 is fixed. On the other hand, the other (for example, the front-side holding member 36) of the pair of holding members 36 is configured so as to be capable of moving toward the one (position-fixed) holding member 36. Here, instead of one holding member 36 moving toward the other holding member 36, both holding members 36 may be configured so as to move toward each other.

Also, a heating member 38 is provided in each holding member 36.

Upon the heating members 38 being heated in a state in which the paired holding members 36 are in close contact with each other via the banknote storing bag 34 as a result of one holding member 36 relatively moving toward the other holding member 36, heat is provided to the parts in the vicinity of the banknote storing bag 34. Consequently, the opening portion of the banknote storing bag 34 can be heat-sealed.

The banknote storing mechanism 32 comprises a banknote feeding section 48 for feeding banknotes fed from the corresponding diverged transport unit 25 to the lower unit 16 to the banknote storing bag 34. Also, the banknote storing mechanism 32 includes temporary storing sections 44 that temporarily store banknotes fed from the banknote feeding section 48. Also, the banknote storing mechanism 32 comprises stages 40 on which a bottom portion of the banknote storing bag 34 is to be placed.

The banknote feeding section 48 comprises a combination of rollers and belts. The banknote feeding section 48 feeds banknotes fed from the diverged transport unit 25 to the lower unit 16 one by one to the temporary storing sections 44.

The temporary storing sections 44 comprises a pair of plate-like members arranged in a front-rear direction (right-left direction in FIG. 2). Banknotes fed by the banknote feeding section 48 are stacked on the temporary storing sections 44. A shaft 44*a* is provided at a proximal end part of each temporary storing section 44. Each of the pair of temporary storing sections 44 is configured so as to be capable of rotating downward (arrow direction in FIG. 2) about the shaft 44*a*.

At least a part of the banknote storing bag 34 held by the holding members 36 is placed on the stages 40. The stages 40 comprise a pair of plate-like members arranged in the front-rear direction (right-left direction in FIG. 2).

Figure 3:
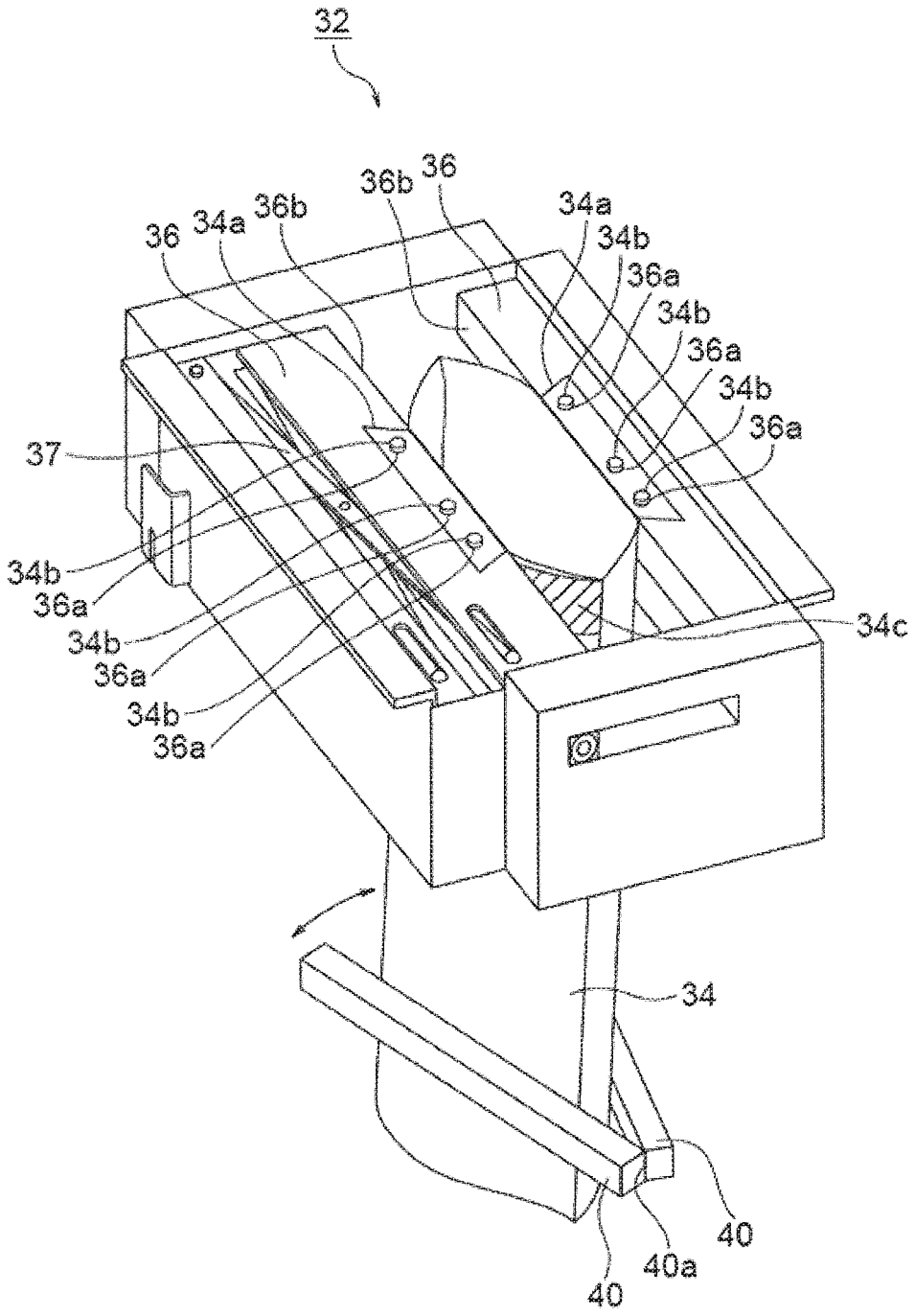
FIG. 3 is a perspective view of holding members and/or the like in a state of holding a bag.

FIG. 3 is a perspective view of a banknote storing mechanism 32. A pair of stages 40 is joined to each other via a hinge portion 40*a* provided at respective end portions of the stages 40. Each stage 40 is configured so as to be capable of horizontally swinging in the arrow direction in FIG. 3 about the hinge portion 40*a*. Upon opening of the stages 40, a gap is formed between the paired stages 40. A banknote storing bag 34 held by holding members 36 is disposed in such a manner that a part of the banknote storing bag 34 extends below the stages 40 through the gap. Here, the stages 40 may be configured in such a manner that either one of the stages 40 swings.

The stages 40 are driven by a stage driving section 41 (see FIG. 10) such as an electric actuator. More specifically, the stages 40 are moved upward/downward and are also horizontally opened/closed about the hinge portion 40*a*, by the stage driving section 41.

FIG. 2 will be referred to again. The stages 40 are configured so as to be capable of moving in a direction away from the pair of holding members 36 and a direction toward the pair of holding members 36 in a predetermined range of movement. In other words, in the case of the present embodiment, the stages 40 are configured so as to be capable of moving upward/downward in the predetermined range of movement. Also, a detection target section (not illustrated) is attached to each stage 40.

The banknote storing mechanism 32 comprises a stage position detection sensor 79 that detects a position in a vertical direction of the pair of stages 40. The stage position detection sensor 79 comprises a first sensor 79*a* and a second sensor 79*b*.

When the stages 40 are positioned at a lower end of the movable range of the stages 40, the first sensor 79*a* detects the detection target sections attached to the stages 40. Also, when the banknote storing bag 34 becomes full or nearly full of banknotes stored, the second sensor 79*b* detects the detection target sections attached to the stages 40.

Also, a heating member 42 is provided in each stage 40. These heating members 42 are configured so as to be capable of heat-sealing a banknote storing bag 34. More specifically, before the banknote storing bag 34 is taken out from the banknote storing mechanism 32, one stage 40 moves toward the other stage 40 and these stages 40 are thereby brought close to each other. In this state, upon heat from the respective heating members 42 being provided to a part of the banknote storing bag 34, the part being a bottom part when banknotes are stored in the banknote storing bag 34, that part is heat-sealed.

Here, a biasing lever 39 is provided below one holding member 36 of the pair of holding members 36. The biasing lever 39 is a member for biasing banknotes stored in the banknote storing bag 34 to one side (left side in the case of FIG. 2) inside the banknote storing bag 34. The biasing lever 39 is moved to the left from the state illustrated in FIG. 2, by a biasing lever driving section 39*a* (see FIG. 10) comprising, for example, an electric actuator, and is moved to the state illustrated in FIG. 2 again.

Figure 4:
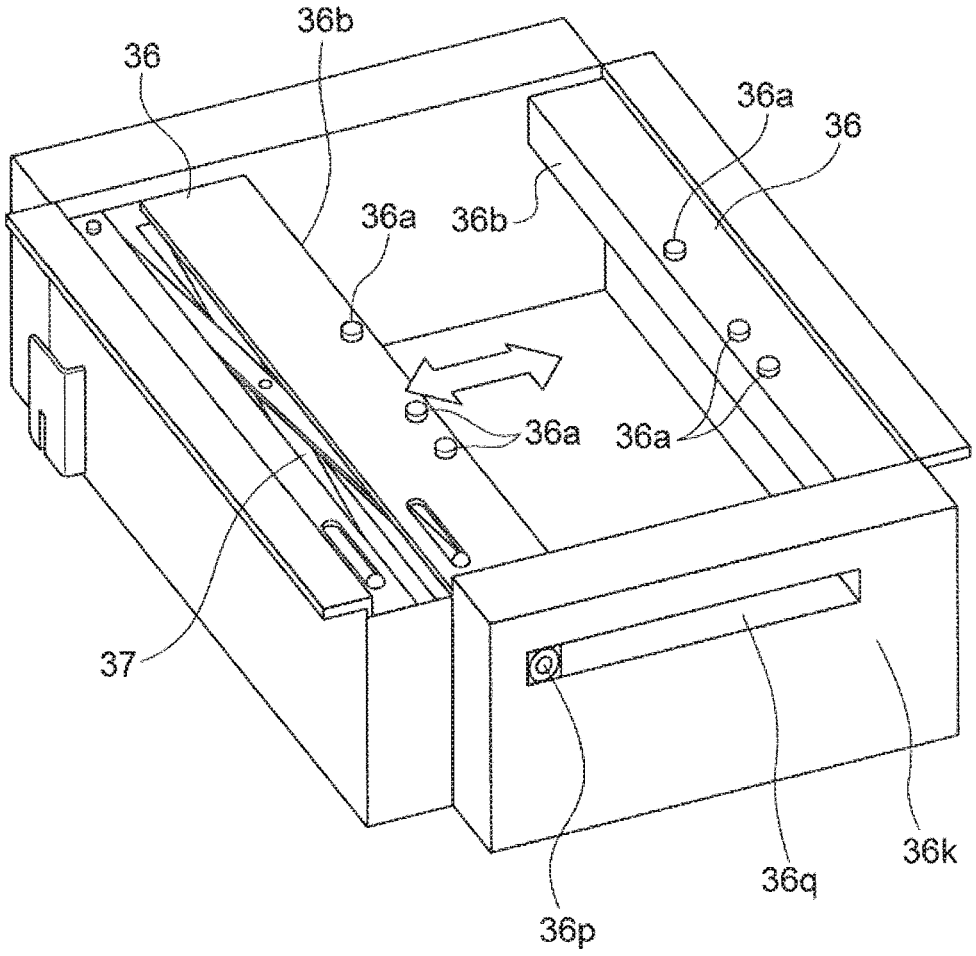
FIG. 4 is a perspective view of holding members and/or the like included in a banknote storing mechanism.

FIG. 4 is a perspective view of holding members 36. A slide mechanism 37 comprising a plurality of links is provided in one holding member 36 (on the left side in FIG. 4) of the pair of holding members 36. Upon the slide mechanism 37 being extended transversely, the one holding member 36 moves toward the other holding member 36.

A guide pin 36*p* is provided at an end portion of the one holding member 36. A horizontally extending linear long hole 36*q* is provided in a frame body 36*k* that supports the holding members 36. The long hole 36*q* guides the guide pin 36*p*. Upon the slide mechanism 37 being extended, the one holding member 36 moves toward the other holding member 36 while the guide pin 36*p* provided in the one holding member 36 is guided along the long hole 36*q*. Such motion brings a surface 36*b* of the one holding member 36 closer to a surface 36*b* of the other holding member 36.

Also, three pins 36*a* are provided at an upper surface of each of the pair of holding members 36.

Figure 5:
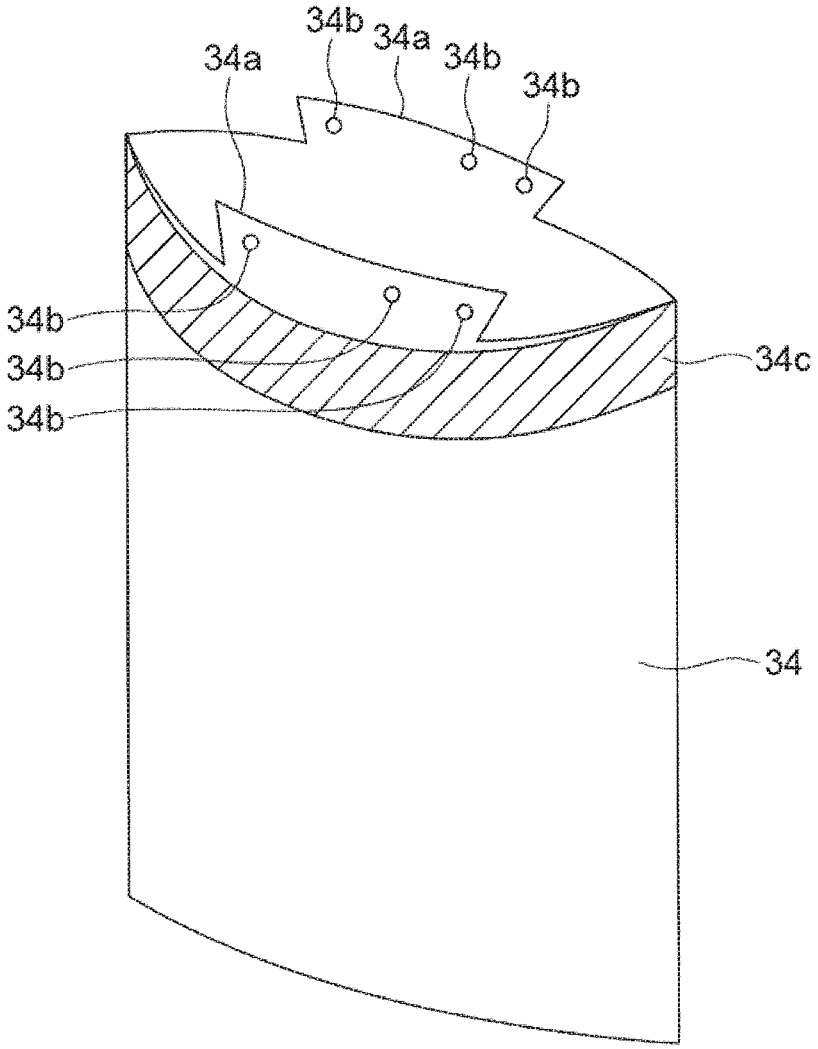
FIG. 5 is a perspective view of a banknote storing bag to be held by holding members.

FIG. 5 is a perspective view of a banknote storing bag 34 to be held by holding members 36. A pair of projection portions 34*a* is provided at parts of the banknote storing bag 34, the parts being in the vicinity of an opening (that is, an upper end portion of the banknote storing bag 34). Three holes 34*b* are provided in each projection portion 34*a*. Upon the pins 36*a* being passed through the respective holes 34*b* (see FIG. 3), the projection portions 34*a* are held by the respective holding members 36, and thus, the banknote storing bag 34 is held by the pair of holding members 36.

Here, as illustrated in FIG. 5, a band-like reinforcement member 34*c* is provided on (attached to) a part of an outer surface of the banknote storing bag 34, the part being in the vicinity of the opening. The reinforcement member 34*c* is formed by a material that is stiffer than that of the other part of the banknote storing bag 34, for example, polyethylene terephthalate. The reinforcement member 34*c* prevents wrinkling of the opening of the banknote storing bag 34. Here, "stiff" means having large stiffness against bending. Also, as a material for forming the reinforcement member 34*c*, one that is limper than that of the other part of the banknote storing bag 34 may be used. Even in this case, provision of the reinforcement member 34*c*, which is another member, allows the vicinity of the opening of the banknote storing bag 34 to be stiffer than the other part. Therefore, wrinkling of the opening is suppressed.

The description of the banknote storing mechanism 32 will be continued with reference to FIG. 2 again. A pressing plate 46 is provided above the pair of temporary storing sections 44. A pantograph 50 is connected to an upper portion of the pressing plate 46. Upon the pantograph 50 being extended/retracted vertically, the pressing plate 46 moves vertically. In other words, the pantograph 50 is a kind of advancing/retracting section that advances/retracts the pressing plate 46. Here, the pantograph 50 is a member configured by joining a plurality of links (50*a* to 50*f*; see FIG. 8) via hinges.

Figure 6:
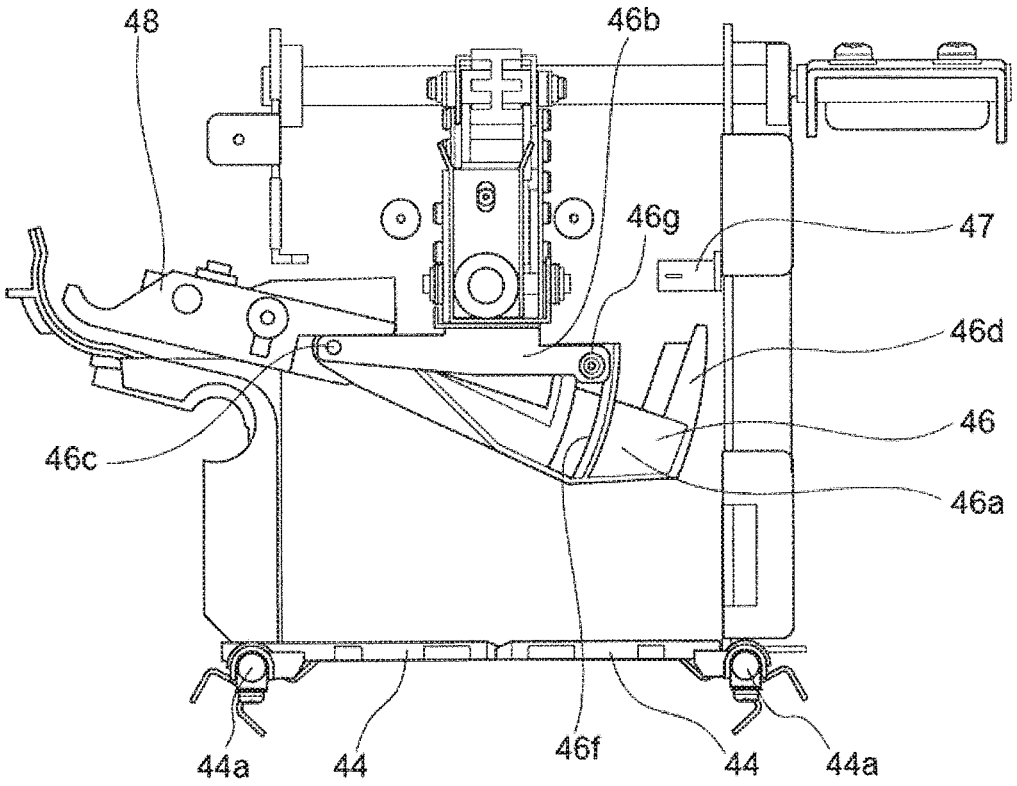
FIG. 6 is a right side view of a pressing plate, temporary storing sections, and/or the like, included in a banknote storing mechanism.
Figure 7:
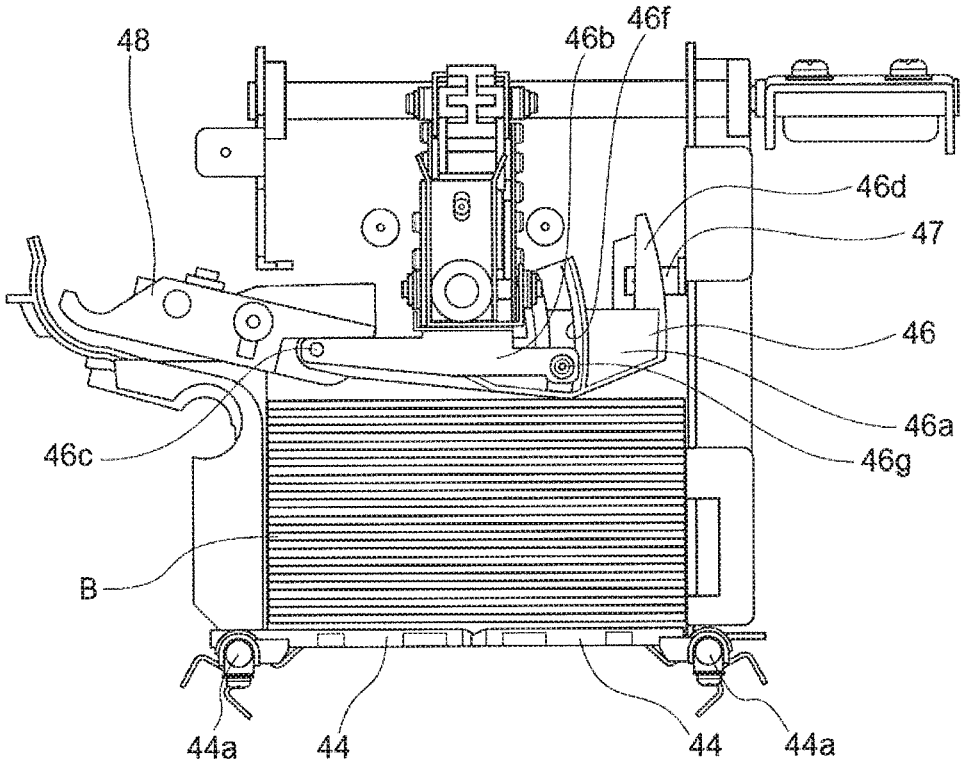
FIG. 7 is a side view of the pressing plate, the temporary storing sections, and/or the like, when the temporary storing sections are full or nearly full of banknotes stored thereon.

Subsequently, a configuration of the pressing plate 46 will be described in detail with reference to FIGS. 6 and 7, which are side views illustrating a configuration of the pressing plate 46, the temporary storing sections 44. FIG. 6 illustrates a state in which no banknotes are stored on the temporary storing sections 44, and FIG. 7 illustrates a state in which the temporary storing sections 44 are full or nearly full of stored banknote bundles B.

The pressing plate 46 comprises a pressing part 46*a* and a base part 46*b*. The pressing part 46*a* is swingable about a shaft 46*c* relative to the base part 46*b*. In detail, an arc-like guide hole 46*f* is provided in the pressing part 46*a*, and a pin member 46*g* inserted in the guide hole 46*f* is provided in the base part 46*b*. The pressing part 46*a* can swing about the shaft 46*c* relative to the base part 46*b* within a range of movement of the pin member 46*g* inside the guide hole 46*f*.

Where no force is applied to the pressing part 46*a*, as illustrated in FIG. 6, the pressing part 46*a* is maintained at a position at which the pressing part 46*a* projects below the base part 46*b* under its own weight.

A banknote feeding section 48 is disposed between the temporary storing sections 44 and the pressing plate 46 (see FIG. 2). Therefore, banknotes fed from the banknote feeding section 48 are fed to and stacked between the temporary storing sections 44 and the pressing plate 46. At this time, the pressing plate 46 also functions as a guide that guides the banknotes. With an increase in amount of banknotes stacked, a stack height of banknotes increases and the pressing part 46*a* is thus pushed upward by the banknotes. Then, the pressing part 46*a* rotates about the shaft 46*c* counterclockwise in FIG. 6. Upon the height of banknotes stacked on the temporary storing sections 44 reaching a predetermined height, as illustrated in FIG. 7, a major part of the pressing part 46*a* retracts above the base part 46*b*.

A detection target member 46*d* is attached to an upper portion of the pressing part 46*a*. Also, a temporary storage amount detection sensor 47 that detects the detection target member 46*d* is provided above the pressing part 46*a*. When the height of banknotes stacked on the temporary storing sections 44 reaches the predetermined height and the detection target member 46*d* thereby reaches a level that is the same as that of the temporary storage amount detection sensor 47, the temporary storage amount detection sensor 47 detects that the detection target member 46*d* has reached a predetermined height. In other words, the temporary storage amount detection sensor 47 detects that banknotes are stacked in a predetermined height on the temporary storing sections 44, that is, the temporary storing sections 44 are full or nearly full of banknotes stored thereon.

Next, operation of the temporary storing sections 44 and the pressing plate 46 will be described with reference to FIGS. 8 and 9, which are perspective views of the circumference of the temporary storing sections 44 and the pressing plate 46.

Figure 8:
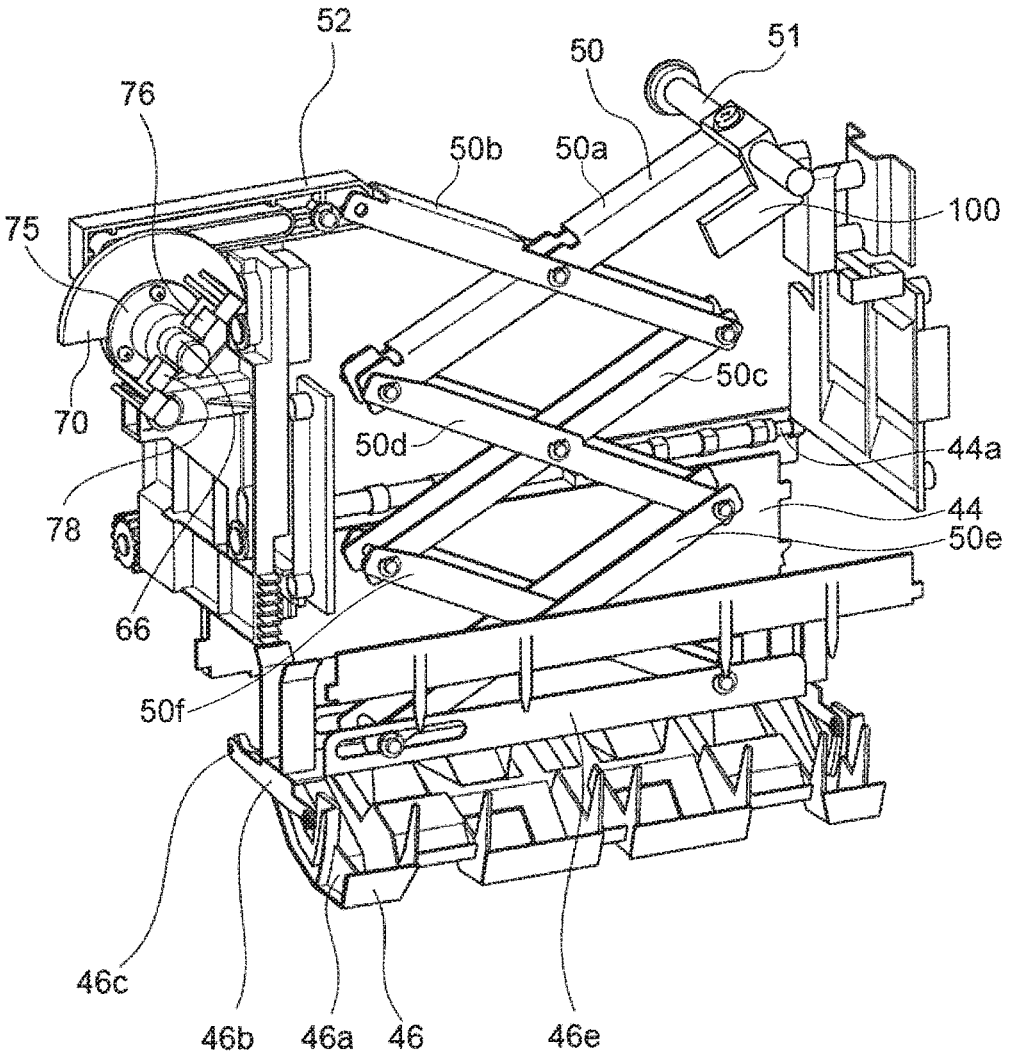
FIG. 8 is a perspective view of a pantograph and/or the like that moves the pressing plate.

FIG. 8 illustrates a state in which a gap is formed between the paired temporary storing sections 44 as a result of the pair of temporary storing sections 44 rotating downward about the respective shafts 44*a* and the pressing plate 46 is lowered through the gap. For sake of convenience, in FIG. 8, illustration of one (on the near side in the sheet of FIG. 8) of the pair of temporary storing sections 44 is omitted.

An attachment member 46*e* is attached to an upper surface of the base part 46*b* of the pressing plate 46. Two lower end portions of the pantograph 50 are attached to the attachment member 46*e*.

One (link 501) of the two lower end portions of the pantograph 50 is rotatably mounted to the attachment member 46*e* via a hinge. The other (link 50*e*) of the two lower end portions of the pantograph 50 is slidably mounted to the attachment member 46*e* via a slide pin that is provided in the attachment member 46*e* and is horizontally movable inside a horizontal long hole extending horizontally.

One (link 50*a*) of two upper end portions of the pantograph 50 is rotatable about a shaft 51 mounted to the relevant upper end portion. The other (link 50*b*) of the two upper end portions of the pantograph 50 is rotatably mounted to an end portion of a rack 52, which is moved horizontally by a non-illustrated pinion, via a hinge.

When the rack 52 is moved in a direction toward the shaft 51 by the non-illustrated pinion, the pantograph 50 is extended downward. Therefore, the pressing plate 46 mounted to the lower end portions of the pantograph 50 moves downward. Conversely, when the rack 52 is moved in a direction away from the shaft 51 by the pinion, the pantograph 50 is retracted upward. Therefore, the pressing plate 46 mounted to the lower end portions of the pantograph 50 moves upward.

A blocking plate 100 having an L-shape in side view is fixed to the shaft 51. Upon rotation of the shaft 51, the blocking plate 100 rotates together with the shaft 51. The blocking plate 100 will be described in detail later.

Figure 9:
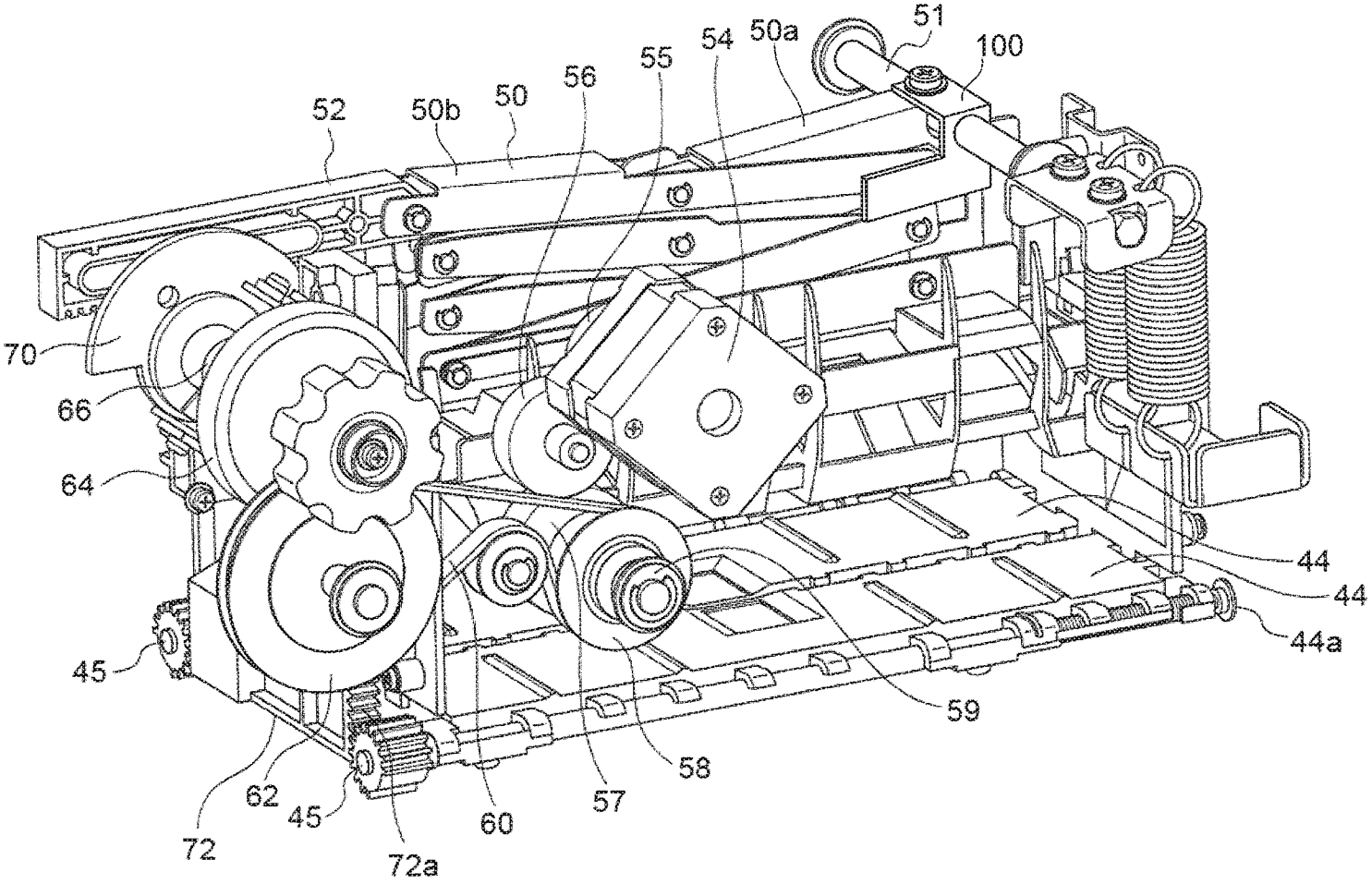
FIG. 9 is a perspective view of the pantograph and a motor, gears, and/or the like that move the pantograph.

FIG. 9 illustrates a state in which the pair of temporary storing sections 44 is horizontal and the pressing plate 46 is positioned above the pair of temporary storing sections 44 as a result of retraction of the pantograph 50.

A stepper motor 54 is disposed in the vicinity of the temporary storing sections 44 and the pressing plate 46. A gear 55 is mounted to the stepper motor 54, and the gear 55 can be rotated by a predetermined angle in both forward and reverse directions by actuating the stepper motor 54 a predetermined number of steps. Also, another gear 56 engages with the gear 55, and still another gear 57 engages with the gear 56.

A pulley 58 is provided on a rotating shaft of the gear 57 so as to rotate in synchronization with the gear 57. A torque sensor 59 is provided on the rotating shaft of the gear 57.

A circulating belt 60 is looped over the pulley 58. Also, the circulating belt 60 is looped over another pulley 62. Furthermore, a gear (not illustrated) is mounted to a rotating shaft of the pulley 62 so as to rotate in synchronization with the pulley 62. Also, another gear 64 engages with the gear. The gear 64 rotates about the rotating shaft 66.

Therefore, upon the gear 55 being rotated by a predetermined angle in the forward direction or the reverse direction by the stepper motor 54, the rotating shaft 66 rotates in a forward direction or a reverse direction.

FIG. 8 will be referred to again. A pinion (not illustrated), a cam 70 and a detection target plate 75 are mounted to the rotating shaft 66. Upon rotation of the rotating shaft 66 by a predetermined angle, the pinion, the cam 70 and the detection target plate 75 also rotate about the rotating shaft 66 by a predetermined angle. Upon the pinion rotating about the rotating shaft 66 by a predetermined angle, the rack 52 is moved a predetermined distance in the direction toward the shaft 51 or the direction away from the shaft 51, and the pantograph 50 thereby extends or retracts a predetermined length.

In other words, the stepper motor 54 is a drive source that provides a driving force for driving the pantograph 50.

Also, two sensors (more specifically, an upper end detection sensor 76 and a lower end detection sensor 78) for detecting the detection target plate 75 are provided in the vicinity of the rotating shaft 66. When the pantograph 50 has completely been retracted and the pressing plate 46 is positioned at an upper end (standby position) of a movable range of the pressing plate 46, the detection target plate 75 is detected by the upper end detection sensor 76. Also, when the pantograph 50 has completely been extended and the pressing plate 46 is positioned at a lower end of the movable range of the pressing plate 46, the detection target plate 75 is detected by the lower end detection sensor 78.

FIG. 9 will be referred to again. A power transmission member 72 is disposed in the vicinity of the cam 70. The power transmission member 72 is a substantially rectangular plate-like member. The power transmission member 72 is disposed so as to extend vertically.

A teeth part 72*a* is formed at least a lower end portion of each of opposite side edges of the power transmission member 72. Also, a gear 45 is mounted to an end portion of each of respective shafts 44*a* of the paired temporary storing sections 44. The gears 45 engage with the respective teeth parts 72*a*.

An upward external force is consistently applied to the power transmission member 72 by, for example, a non-illustrated spring.

Also, a non-illustrated roller is rotatably mounted to the power transmission member 72. An outer circumferential surface of the roller is disposed so as to be in contact with an outer circumferential surface of the cam 70.

Upon the rotating shaft 66 and the cam 70 rotating clockwise in FIG. 9 as a result of rotation of the stepper motor 54, the roller is pushed downward by the outer circumferential surface of the cam 70. Then, the power transmission member 72 moves downward against the aforementioned external force. Subsequently, the gears 45 are rotated by the respective teeth parts 72*a* moving downward. Therefore, the temporary storing sections 44 rotate downward about the respective shafts 44*a*.

In other words, upon forward or reverse rotation of the stepper motor 54, the pressing plate 46 moves upward or downward and the pair of temporary storing sections 44 rotate so as to open or be closed.

Figure 10:
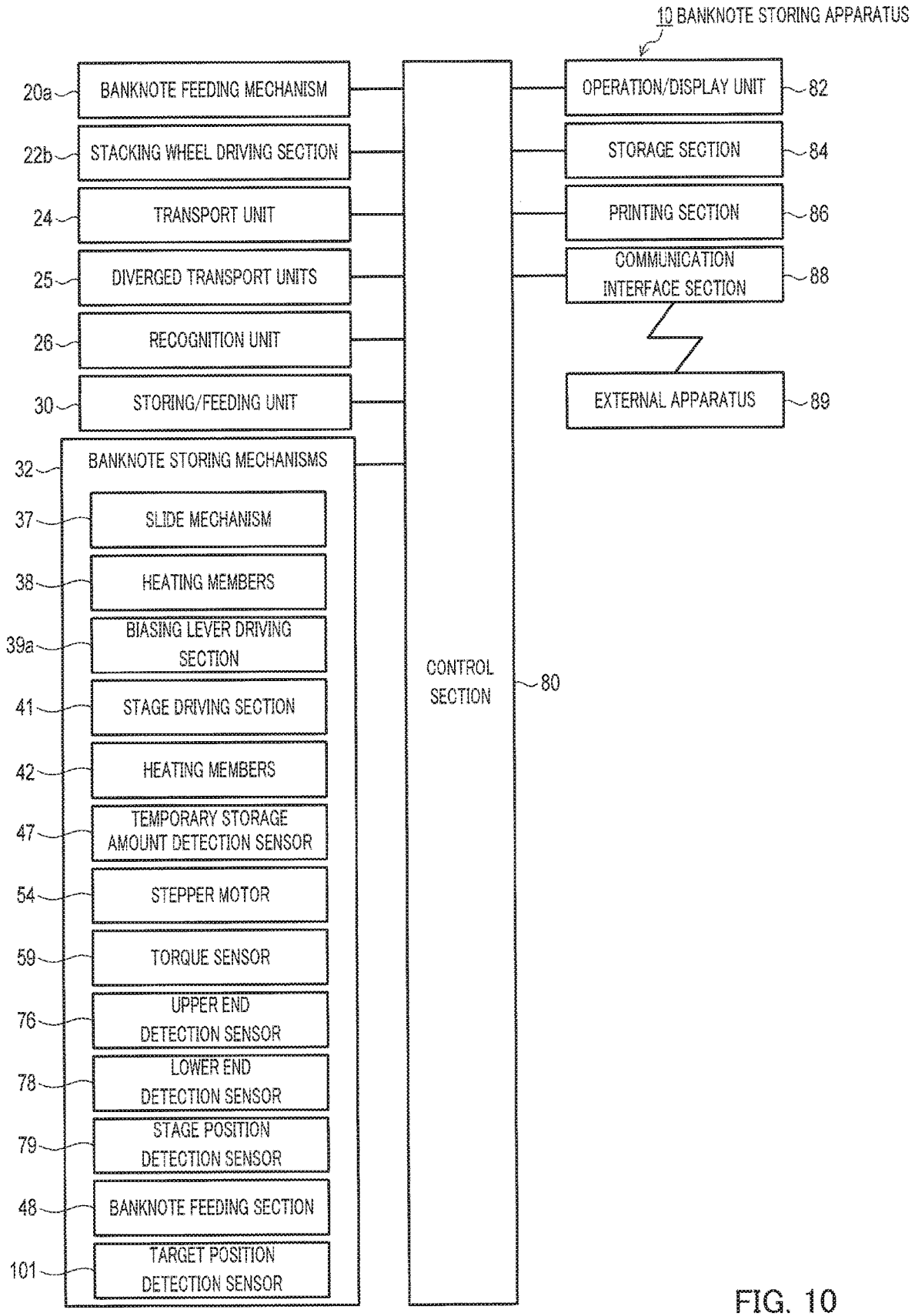
FIG. 10 is a function block diagram illustrating a configuration of a control system of the banknote storing apparatus.

FIG. 10 is a function block diagram illustrating a configuration of a control system of the banknote storing apparatus 10. The banknote storing apparatus 10 comprises the control section 80.

The control section 80 is connected to a banknote feeding mechanism 20*a* provided in the inlet 20, a stacking wheel driving section 22*b* for driving the stacking wheel 22*a* provided in the outlet 22, the transport unit 24, the diverged transport units 25, the recognition unit 26 and the storing/feeding unit 30. Also, the control section 80 is connected to the banknote storing mechanisms 32. Here, each banknote storing mechanism 32 comprises a slide mechanism 37, heating members 38, a biasing lever driving section 39*a*, a stage driving section 41, heating members 42, a temporary storage amount detection sensor 47, a stepper motor 54, an upper end detection sensor 76, a lower end detection sensor 78, a stage position detection sensor 79, a banknote feeding section 48 and a target position detection sensor 101.

Pieces of information of results of recognition of banknotes by the recognition unit 26 and pieces of information of detection by each temporary storage amount detection sensor 47, each upper end detection sensor 76, each lower end detection sensor 78, each stage position detection sensor 79 and each target position detection sensor 101 are transmitted to the control section 80. The control section 80 controls the respective units comprised in the banknote storing apparatus 10 based on these pieces of information.

Also, the operation/display unit 82, a storage section 84, a printing section 86 and a communication interface section 88 are connected to the control section 80. The operation/display unit 82 has been described above.

The storage section 84 stores processing records of banknote deposit processing in the banknote storing apparatus 10 and information relating to respective inventory amounts of banknotes stored in the respective banknote storing bags 34.

The printing section 86 prints processing records of banknote deposit processing in the banknote storing apparatus 10 and information relating to respective inventory amounts of banknotes stored in the respective banknote storing bags 34, on a receipt.

Also, the control section 80 can transmit/receive information to/from an external apparatus 89 (more specifically, for example, an upper terminal) provided separately from the banknote storing apparatus 10, via the communication interface section 88. For example, information stored in the storage section 84 is transmitted to the external apparatus 89. More specifically, for example, when a security guard of a cash-in-transit company collects banknotes of each banknote storing bag 34, information relating to the collected banknotes is transmitted to a computer in the transportation security company, which is the external apparatus 89.

Next, operation of the banknote storing apparatus 10 in storing banknotes in the banknote storing bag 34 will be described. Here, the respective units comprised in the banknote storing apparatus 10 operate as a result of the control section 80 controlling the respective units.

Upon the operation/display unit 82 being operated by an operator and banknotes being put into the inlet 20, the banknotes put in the inlet 20 are fed one by one into the casing 12 and transported by the transport unit 24. Subsequently, a denomination, authenticity, a face/back, fitness, new series/old series, a transport state of each banknote are recognized by the recognition unit 26.

Banknotes recognized as normal banknotes by the recognition unit 26 are fed to the storing/feeding unit 30 and temporarily stored in the storing/feeding unit 30. The counts of banknotes of respective denominations, the banknotes being temporarily stored in the storing/feeding unit 30, and a total amount of the banknotes are displayed on the operation/display unit 82. Upon the operator confirming the content of the display and performing an operation to approve deposit processing, the banknotes are fed one by one from the storing/feeding unit 30 to the transport unit 24. Each banknote passes through the transport unit 24, the diverged transport unit 25 and the banknote feeding section 48 and is transported to and stacked on the pair of temporary storing sections 44 disposed above a banknote storing bag 34 in which the banknote should be stored.

The control section 80 receives pieces of information of results of the recognition by the recognition unit 26, and based on the pieces of information, calculates the number of banknotes stacked on the pair of temporary storing sections 44 and stores the number. The control section 80 calculates the number of banknotes stored in the banknote storing bag 34 by adding the number, and stores the calculated number.

Banknotes recognized as being not normal banknotes by the recognition unit 26, what is called rejected banknotes, are fed to the outlet 22 by the transport unit 24 and stacked in the outlet 22. As necessary, the operator can take out the rejected banknotes stacked in the outlet 22 from the front surface of the casing 12 and put the banknotes into the inlet 20 again.

Upon a banknote bundle B of a predetermined number of, for example, 100 banknotes being stacked on the pair of temporary storing sections 44, the stepper motor 54 rotates. Then, each temporary storing section 44 rotates downward (that is, the arrow direction in FIG. 2) about the shaft 44*a*. Therefore, the banknote bundle B on the pair of temporary storing sections 44 falls under their own weight with the vertically stacked state kept and are stored in the banknote storing bag 34. When there is a banknote bundle B previously stored in the banknote storing bag 34, the banknote bundle B that had been stored on the pair of temporary storing sections 44 falls on that banknote bundle B.

Upon the stepper motor 54 rotating, the pantograph 50 extends downward and the pressing plate 46 moves downward. Therefore, when the banknote bundle B temporarily stored on the pair of temporary storing sections 44 falls into and is stored in the banknote storing bag 34, the pressing plate 46 can press an upper surface of the banknote bundle B, enabling the stacked state of the banknote bundle B to be maintained. Also, even when some of the banknotes remain on the temporary storing sections 44, such banknotes are pressed into the banknote storing bag 34 by the pressing plate 46.

Upon movement of the banknote bundle B from the temporary storing sections 44 into the banknote storing bag 34, the relevant pair of stages 40 is moved downward by an amount corresponding to a stack height of the moved banknote bundle B, by the relevant stage driving section 41. Subsequently, the pressing plate 46 moves to the upper end of the movable range, that is, the standby position. Therefore, space for storing a next banknote bundle B to be moved from the temporary storing sections 44 into the banknote storing bag 34 is formed inside the banknote storing bag 34, more specifically, above the banknote bundle B stacked inside the banknote storing bag 34.

However, when at least some of the moved banknotes are banknotes that cannot be flattened or cannot easily be flattened (hereinafter, "non-flat banknotes") because the banknotes are, for example, wrinkled or folded, the following problem occurs. When the pressing plate 46 is moved to the standby position to prevent a pressing force from being applied to the banknotes from the pressing plate 46, the banknote bundle B stacked inside the banknote storing bag 34 may expand, resulting in a rise of the upper surface of the banknote bundle B. If such rise occurs, a volume of the space for storing next banknotes to be moved from the temporary storing sections 44 into the banknote storing bag 34 decreases. Consequently, a failure to fully store the moved banknote bundle B in the banknote storing bag 34 may occur. If such failure occurs, an opening of the banknote storing bag 34 cannot properly be sealed, which may cause detective sealing.

Therefore, each banknote storing mechanism 32 comprised in the banknote storing apparatus 10 operates in modes 1 to 3 described below. First, mode 1 will be described.

(Mode 1)

Figure 11:
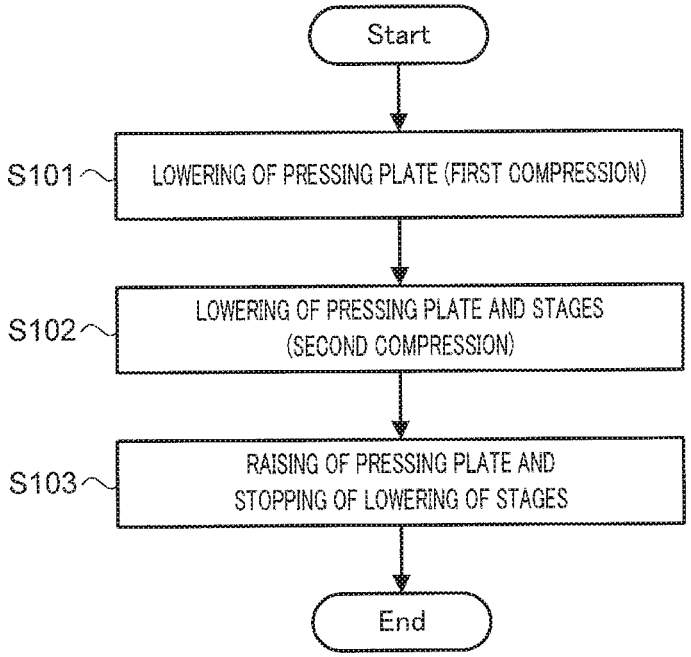
FIG. 11 is a flowchart illustrating operation of the banknote storing apparatus in mode 1.
Figure 12A:
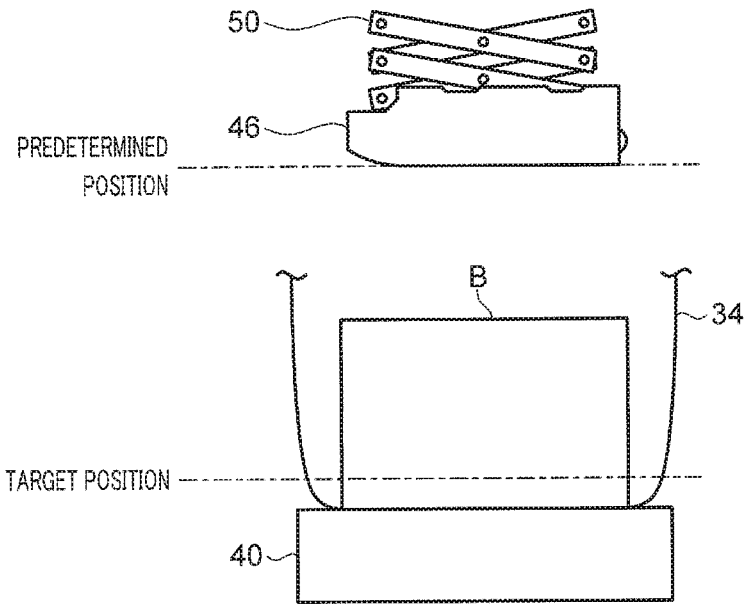
FIG. 12A is a schematic diagram illustrating operation of the banknote storing apparatus during execution of mode 1.

FIG. 11 is a flowchart illustrating operation of a banknote storing mechanism 32 in mode 1. FIG. 12A illustrates a state of the banknote storing mechanism 32 at a start of mode 1.

As illustrated in FIG. 12A, at the start of operation in mode 1, a banknote bundle B including non-flat banknotes is stored in an uncompressed state inside a banknote storing bag 34. The banknote storing bag 34 is at least partially supported from below by the relevant stages 40.

Also, when a banknote bundle B falls into the banknote storing bag 34, the relevant temporary storing sections 44 move downward and the relevant pantograph 50 is partially extended downward, and the pressing plate 46 moves downward by the extension of the pantograph 50. Hereinafter, a position of the pressing plate 46 at this time is referred to as a predetermined position, as necessary.

In other words, at the start of operation in mode 1, the banknote bundle B is supported from below the banknote storing bag 34 by the stages 40, and the pressing plate 46 is located at the predetermined position. Also, the banknote bundle B is relatively large because of inclusion of the non-flat banknotes and a stack height of the banknote bundle B is larger than the case where all of banknotes in the banknote bundle B are mint condition.

Here, the target position indicated in FIG. 12A is a position at which an upper surface of the banknote bundle B is located after completion of operation in mode 1. In other words, the target position is a position at which an upper surface of a banknote bundle B that fell into the banknote storing bag 34 last time and is stored in the banknote storing bag 34 was located before the start of the operation in mode 1. In other words, a certain part of the banknote bundle B, the certain part being above the target position in FIG. 12A, is a banknote that has fallen into the banknote storing bag 34 from the temporary storing sections 44 last.

Upon the start of operation in mode 1, the pantograph 50 is further extended downward, and the pressing plate 46 is lowered further from the predetermined position (S101). After the pressing plate 46 comes into contact with the upper surface of the banknote bundle B, the pressing plate 46 is lowered until the pressing plate 46 reaches a predetermined height above the target position while the pressing plate 46 compresses the banknote bundle B.

Figure 12B:
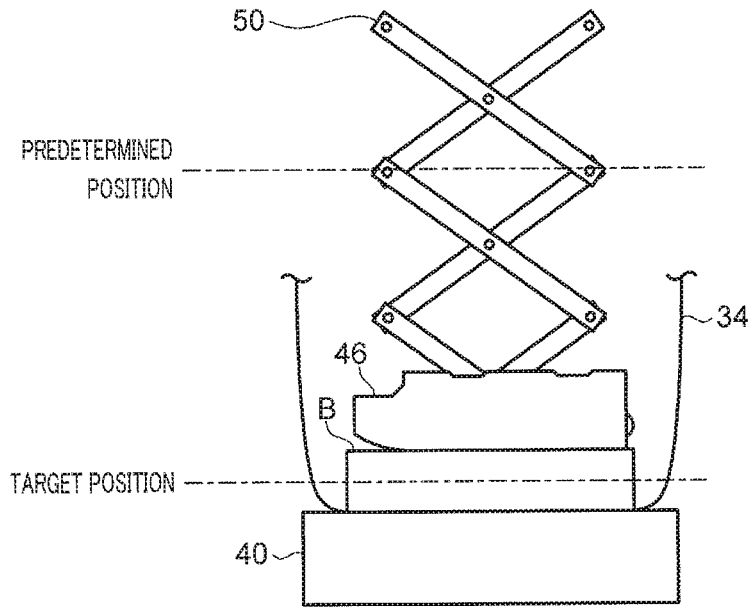
FIG. 12B is a schematic diagram illustrating operation of the banknote storing apparatus during execution of mode 1.

FIG. 12B illustrates a state in which the pressing plate 46 reaches the predetermined height above the target position. The predetermined height refers to a provisional stack height of the banknote bundle B that has fallen into the banknote storing bag 34 last where banknotes in the banknote bundle B that has fallen last are all brand-new banknotes.

In this step, the banknote bundle B are compressed vertically by the stages 40 supporting the banknote bundle B from below via the banknote storing bag 34 and the pressing plate 46 applying a pressing force to the upper surface of the banknote bundle B (hereinafter, the pressing force applied at this time is referred to as "first pressing force" and the compression performed at this time is referred to as "first compression"). In other words, the stages 40 form a support section that supports the banknote bundle B from below via the banknote storing bag 34 and the pressing plate 46 is a pressing section that applies a pressing force to the upper surface of the banknote bundle B. Also, a compression section is made up of the stages 40 and the pressing plate 46.

Here, the pressing plate 46 reaching the predetermined height above the target position can be detected by a predetermined sensor that detects a position of the pressing plate 46. Also, the pressing plate 46 may be made to reach that position by actuating the stepper motor 54 a predetermined number of steps calculated based on the provisional stack height of the last fallen banknote bundle B. Conversely, a position of a lower surface of the pressing plate 46 can be detected by detecting the number of steps, that is, operation of the relevant stepper motor 54.

Figure 12C:
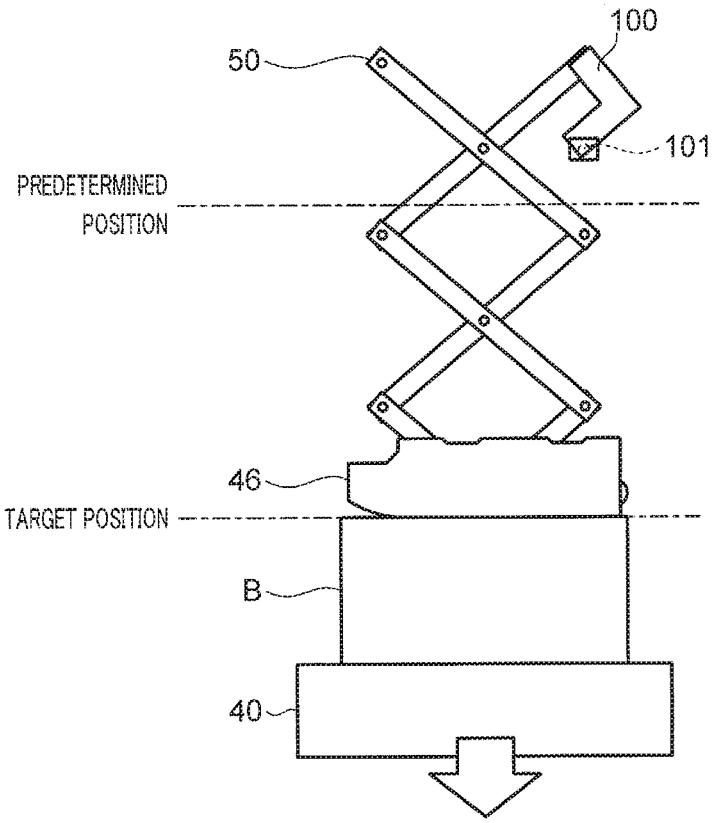
FIG. 12C is a schematic diagram illustrating operation of the banknote storing apparatus during execution of mode 1.

Subsequently, the pressing plate 46 and the stages 40 are lowered simultaneously (S102). The pressing plate 46 is lowered until the lower surface of the pressing plate 46 reaches the target position. Also, the stages 40 move a distance that is larger than a distance of the movement of the pressing plate 46. FIG. 12C illustrates a state in which the respective movements have been completed. In the step, the banknote bundle B is pressed by a second pressing force that is smaller than the first pressing force and is thereby compressed. In other words, second compression is performed.

Figure 12D:
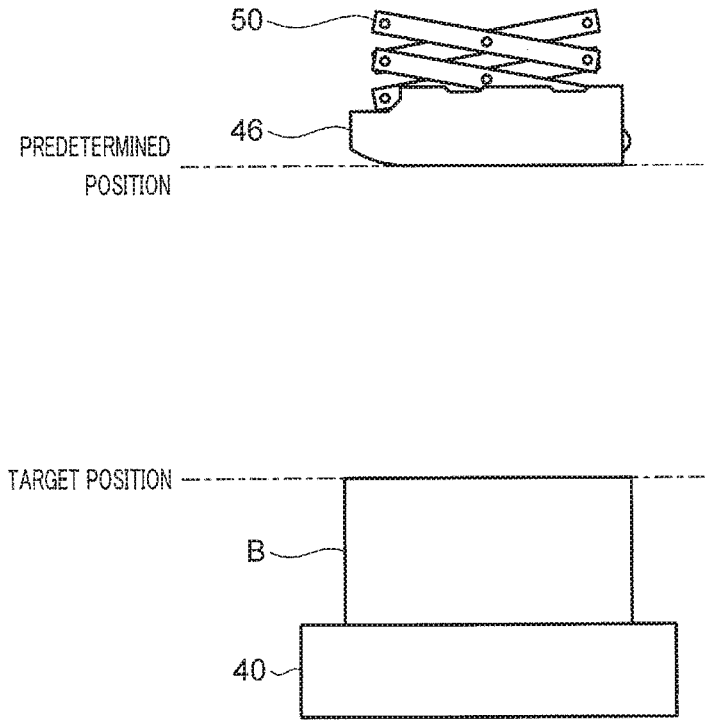
FIG. 12D is a schematic diagram illustrating operation of the banknote storing apparatus during execution of mode 1.

The lower surface of the pressing plate 46 reaching the target position is detected by the relevant target position detection sensor 101. The target position detection sensor 101 is a photo interrupter comprising a light-emitting element and a light-receiving element. The target position detection sensor 101 is mounted at a position where the relevant blocking plate 100 can first come between the light-emitting element and the light-receiving element when the pantograph 50 has been extended downward until the lower surface of the pressing plate 46 reaches the target position. In other words, the target position detection sensor 101 detects a position of the blocking plate 100, that is, a position of a link member to which the blocking plate 100 is attached. In FIGS. 12A and 12B, and FIG. 12D referred to later, neither the blocking plate 100 nor the target position detection sensor 101 is illustrated for sake of convenience.

Upon the pantograph 50 being extended downward until the lower surface of the pressing plate 46 reaches the target position, the blocking plate 100 attached to the pantograph 50 comes between the light-emitting element and the light-receiving element. Then, the target position detection sensor 101 transmits a signal indicating that light is interrupted, that is, the signal indicating that the lower surface of the pressing plate 46 has reached the target position (first signal) to the control section 80. Upon receipt of this signal, the control section 80 stops the lowering of the pressing plate 46.

An amount of movement of the stages 40 can be set to be a predetermined height according to the number of banknotes included in the last fallen banknote bundle B and an empirically obtained height of expansion of non-flat banknotes. Also, it is possible that: a pressure sensor that detects pressure applied from a banknote bundle B is provided on the stages 40 or the pressing plate 46 in advance; and the stages 40 are lowered until pressure detected by the pressure sensor becomes zero or a pressure corresponding the self-weight of the banknote bundle B.

Upon the pressing plate 46 being lowered to the target position and the stages 40 being lowered to a predetermined height below the target position, the pressing plate 46 is raised and the stages 40 stops at the present position (S103). FIG. 12D illustrates a state in which the pressing plate 46 has been raised to the predetermined position. The operation of the banknote storing mechanism 32 in mode 1 is completed as above. After completion of mode 1, the pressing plate 46 is moved further above the predetermined position, and simultaneously, the pair of temporary storing sections 44 is rotated upward, and thus the pressing plate 46 and the pair of temporary storing sections 44 both return the state illustrated in FIG. 2.

Execution of mode 1 enables an upper surface of a banknote bundle B stored inside a banknote storing bag 34 to be located at a target position. Therefore, even when non-flat banknotes that are likely to expand in a stacking direction are included in the banknote bundle B, sufficient space for storing a next banknote bundle B can be formed inside the banknote storing bag 34, more specifically, above the stored banknote bundle B. Therefore, a failure that the banknote storing bag 34 is overflowing with banknotes fallen from the temporary storing section 44 can be prevented. Therefore, when an opening of the banknote storing bag 34 is heat-sealed by the relevant heating members 38, it is possible to prevent a banknote from being stuck in a sealed part and thus prevent defective sealing.

(Mode 2)

Figure 13:
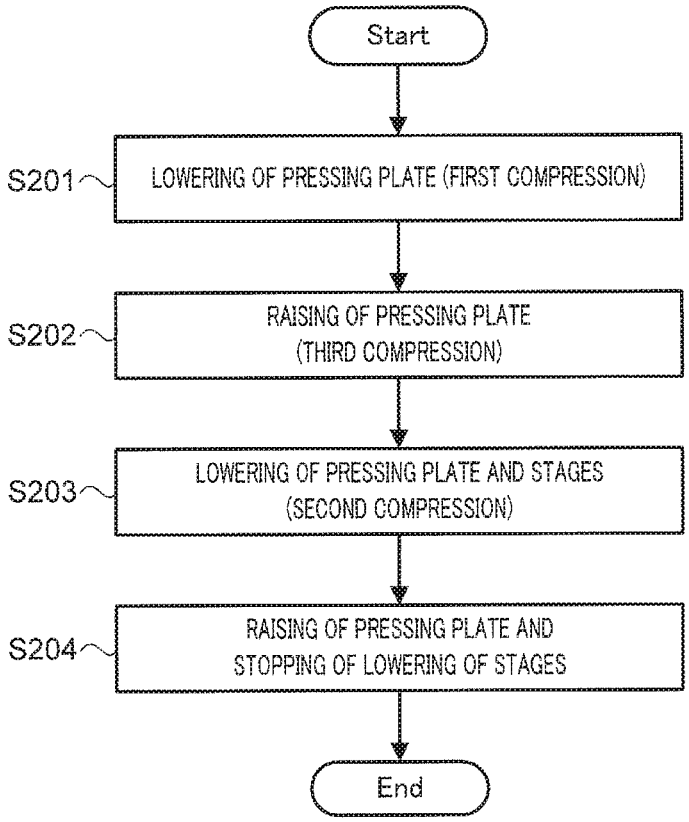
FIG. 13 is a flowchart illustrating operation of the banknote storing apparatus in mode 2.
Figure 14A:
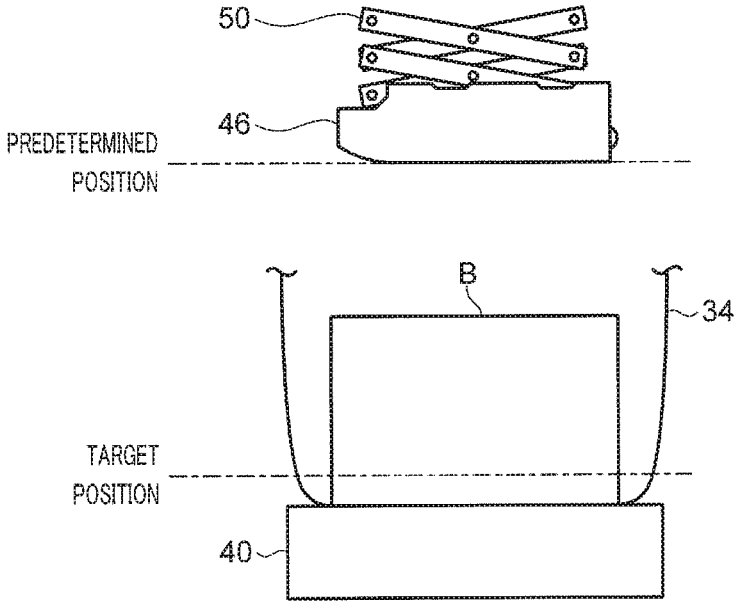
FIG. 14A is a schematic diagram illustrating operation of the banknote storing apparatus during execution of mode 2.

Next, mode 2, which is another operation mode for the banknote storing mechanisms 32, will be described. FIG. 13 is a flowchart illustrating operation of a banknote storing mechanism 32 in mode 2. FIG. 14A illustrates a state of the banknote storing mechanism 32 at a start of mode 2.

A state in which operation in mode 2 is started is the same as the state in which operation in mode 1 is started.

Upon a start of operation in mode 2, the relevant pantograph 50 extended downward simultaneously with rotation of the relevant temporary storing sections 44 (fall of a banknote bundle B) is further extended downward and the relevant pressing plate 46 is further lowered from a predetermined position (S201). After the pressing plate 46 comes into contact with an upper surface of the banknote bundle B, the pressing plate 46 is lowered until the pressing plate 46 reaches a predetermined height above a target position while the pressing plate 46 compresses the banknote bundle B.

Figure 14B:
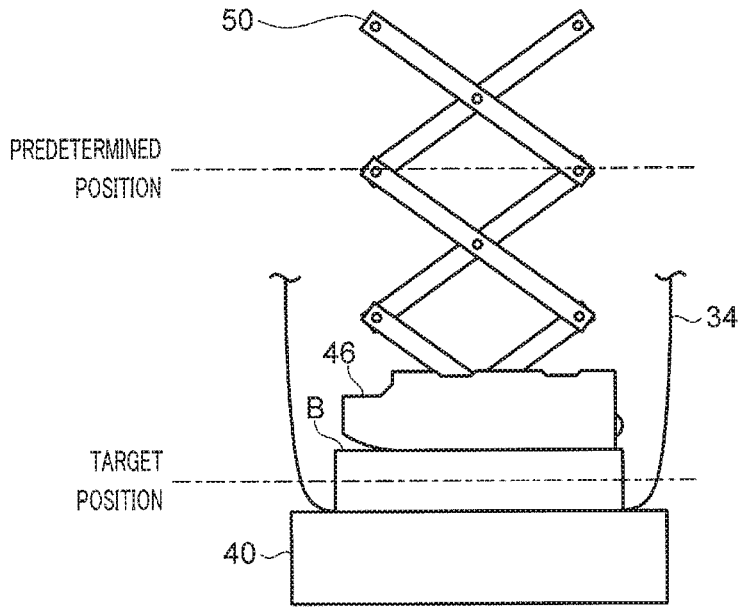
FIG. 14B is a schematic diagram illustrating operation of the banknote storing apparatus during execution of mode 2.

FIG. 14B illustrates a state in which the pressing plate 46 has reached the predetermined height above the target position. The predetermined height refers to a provisional stack height of a banknote bundle B that has fallen into the banknote storing bag 34 last where banknotes in the banknote bundle B are all brand-new banknotes.

In this step, the banknote bundle B is compressed vertically by the stages 40 that supports the banknote bundle B from below via the banknote storing bag 34 and the pressing plate 46 applying a pressing force to the upper surface of the banknote bundle B (hereinafter, the pressing force applied at this time is referred to as "first pressing force" and the compression performed at this time is referred to as "first compression"). In other words, the stages 40 form a support section that supports the banknote bundle B from below via the banknote storing bag 34 and the pressing plate 46 is a pressing section that applies a pressing force to the upper surface of the banknote bundle B. Also, a compression section is made up of the stage 40 and the pressing plate 46.

Here, the pressing plate 46 reaching the predetermined height above the target position can be detected by a predetermined sensor that detects a position of the pressing plate 46. Also, the pressing plate 46 may be made to reach that position by actuating the relevant stepper motor 54 a predetermined number of steps calculated based on the provisional stack height of the last fallen banknote bundle B. Conversely, a position of a lower surface of the pressing plate 46 can be detected by detecting the number of steps, that is, operation of the stepper motor 54.

Figure 14C:
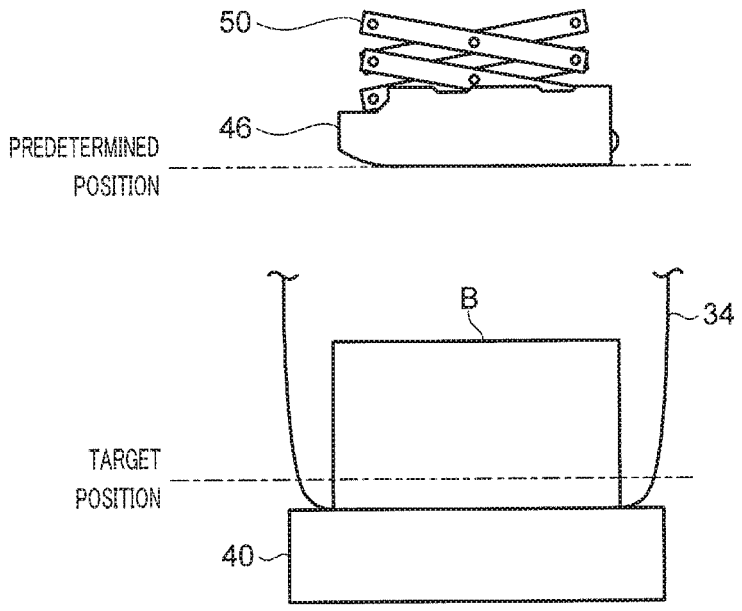
FIG. 14C is a schematic diagram illustrating operation of the banknote storing apparatus during execution of mode 2.

Next, as illustrated in FIG. 14C, the pressing plate 46 is raised to a position at which the lower surface thereof is away from the upper surface of the banknote bundle B (S202). At this time, a pressing force due to the self-weight is applied downwardly to the banknote bundle B (hereinafter, the pressing force applied at this time is referred to as "third pressing force" and compression performed at this time is referred to as "third compression"). In additional case, the pressing plate 46 may be raised, but the lower surface thereof is not away from the upper surface of the banknote bundle B. In this case, a sum of the pressing force due to the self-weight of the banknote bundle B and the pressing force applied by the pressing plate 46 is the third pressing force. In any case, in mode 2, the third pressing force is a force that is smaller than the first pressing force.

As you can be understood when FIG. 14A and FIG. 14C are compared with each other, the first compression reduces a stack height of the banknote bundle B including non-flat banknotes.

In order to align the upper surface of the banknote bundle B with the target position while the pressing plate 46 further reduces the stack height of the banknote bundle B, the pressing plate 46 and the stages 40 are lowered simultaneously (S203). More specifically, the pressing plate 46 is lowered until the lower surface of the pressing plate 46 comes into contact with the upper surface of the banknote bundle B and the lower surface of the pressing plate 46 reaches the target position. Also, the stages 40 are moved until respective upper surfaces of the stages 40 reach a predetermined height below the target position.

The lower surface of the pressing plate 46 reaching the target position is detected by the relevant target position detection sensor 101. The target position detection sensor 101 is a photo interrupter comprising a light-emitting element and a light-receiving element. The target position detection sensor 101 is mounted at a position where the relevant blocking plate 100 can first come between the light-emitting element and the light-receiving element when the pantograph 50 is extended downward until the lower surface of the pressing plate 46 reaches the target position. In other words, the target position detection sensor 101 detects a position of the blocking plate 100, that is, a position of a link member to which the blocking plate 100 is attached. In FIGS. 14A, 14B and 14C, and FIG. 14E referred to later, neither the blocking plate 100 nor the target position detection sensor 101 is illustrated for sake of convenience.

Upon the pantograph 50 being extended downward until the lower surface of the pressing plate 46 reaches the target position, the blocking plate 100 attached to the pantograph 50 comes between the light-emitting element and the light-receiving element. Then, the target position detection sensor 101 transmits a signal indicating that light is blocked, that is, a signal indicating that the lower surface of the pressing plate 46 has reached the target position (first signal) to the control section 80. Upon receipt of this signal, the control section 80 stops the lowering of the pressing plate 46.

Figure 14D:
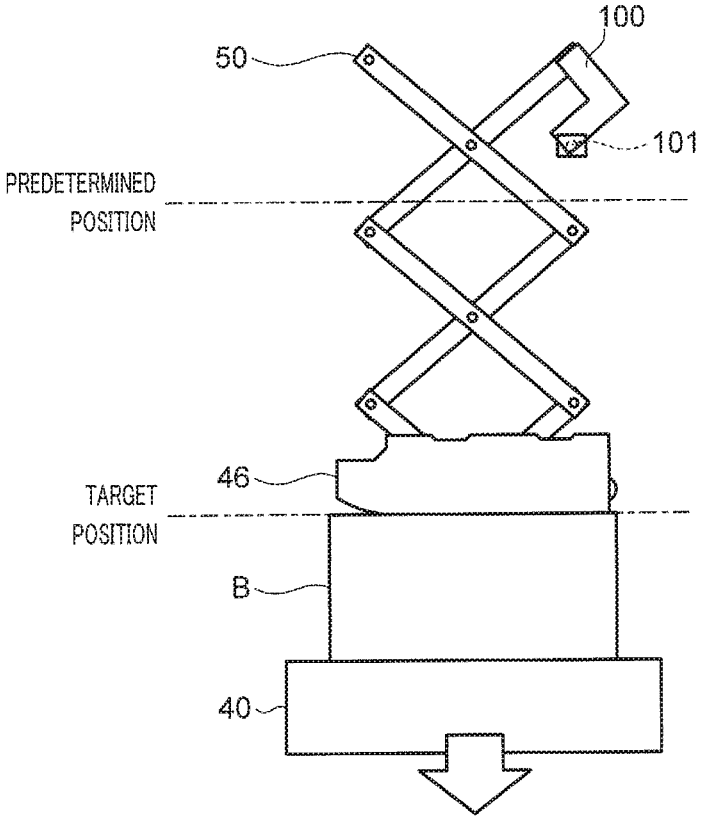
FIG. 14D is a schematic diagram illustrating operation of the banknote storing apparatus during execution of mode 2.

FIG. 14D illustrates a state in which the respective movements have been completed. In this step, the banknote bundle B is pressed and compressed by a second pressing force. In other words, second compression is performed. In mode 2, the second pressing force is smaller than the first pressing force but is larger than the third pressing force.

Here, when the stack height of the banknote bundle B is sufficiently reduced by the first compression, in the step of performing the second compression, the banknote bundle B may be prevented from being pressed by the pressing plate 46. In other words, the pressing plate 46 and the stages 40 may be lowered until the lower surface of the pressing plate 46 reaches the target position in a state in which the pressing plate 46 is in contact with the upper surface of the banknote bundle B, but the pressing plate 46 does not press the banknote bundle B. In this case, the second pressing force is the self-weight of the banknote bundle B alone and is equal to the third pressing force.

An amount of movement of the stages 40 can be set to be a predetermined height according to the number of banknotes included in the last fallen banknote bundle B and an empirically obtained height of expansion of non-flat banknotes. Also, it is possible that: a pressure sensor that detects pressure applied from a banknote bundle B is provided on the stages 40 or the pressing plate 46 in advance; and the stages 40 are lowered until pressure detected by the pressure sensor becomes zero or a pressure corresponding to the self-weight of the banknote bundle B.

Figure 14E:
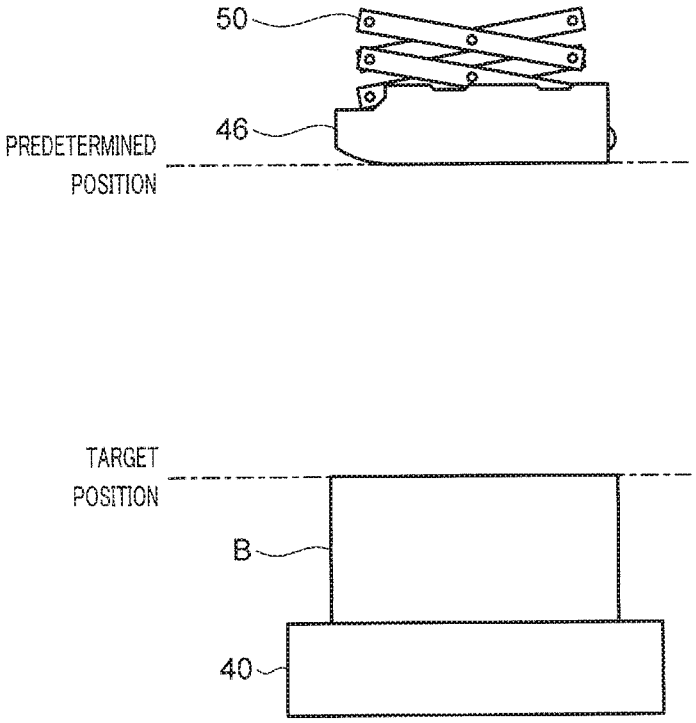
FIG. 14E is a schematic diagram illustrating operation of the banknote storing apparatus during execution of mode 2.

Upon the pressing plate 46 being lowered to the target position and the stages 40 being lowered to a predetermined height below the target position, the pressing plate 46 is raised and the stage 40 stops at the present position (S204). FIG. 14E illustrates a state in which the pressing plate 46 has been raised to the predetermined position. The operation of the banknote storing mechanism 32 in mode 2 is completed as above. After completion of mode 2, the pressing plate 46 is moved further above the predetermined position, and simultaneously, the pair of temporary storing sections 44 is rotated upward, and thus the pressing plate 46 and the pair of temporary storing sections 44 both return the state illustrated in FIG. 2.

Execution of mode 2 enables an upper surface of a banknote bundle B stored inside a banknote storing bag 34 to be located at a target position. Therefore, even when non-flat banknotes that are likely to expand in a stacking direction are included in the banknote bundle B, sufficient space for storing a next banknote bundle B can be formed inside the banknote storing bag 34, more specifically, above the stored banknote bundle B. Therefore, a failure that the banknote storing bag 34 is overflowing with banknotes fallen from the temporary storing section 44 can be prevented. Therefore, when an opening of the banknote storing bag 34 is heat-sealed by heating members 38, it is possible to prevent a banknote from being stuck in a sealed part and thus prevent detective sealing.

(Mode 3)

Figure 15:
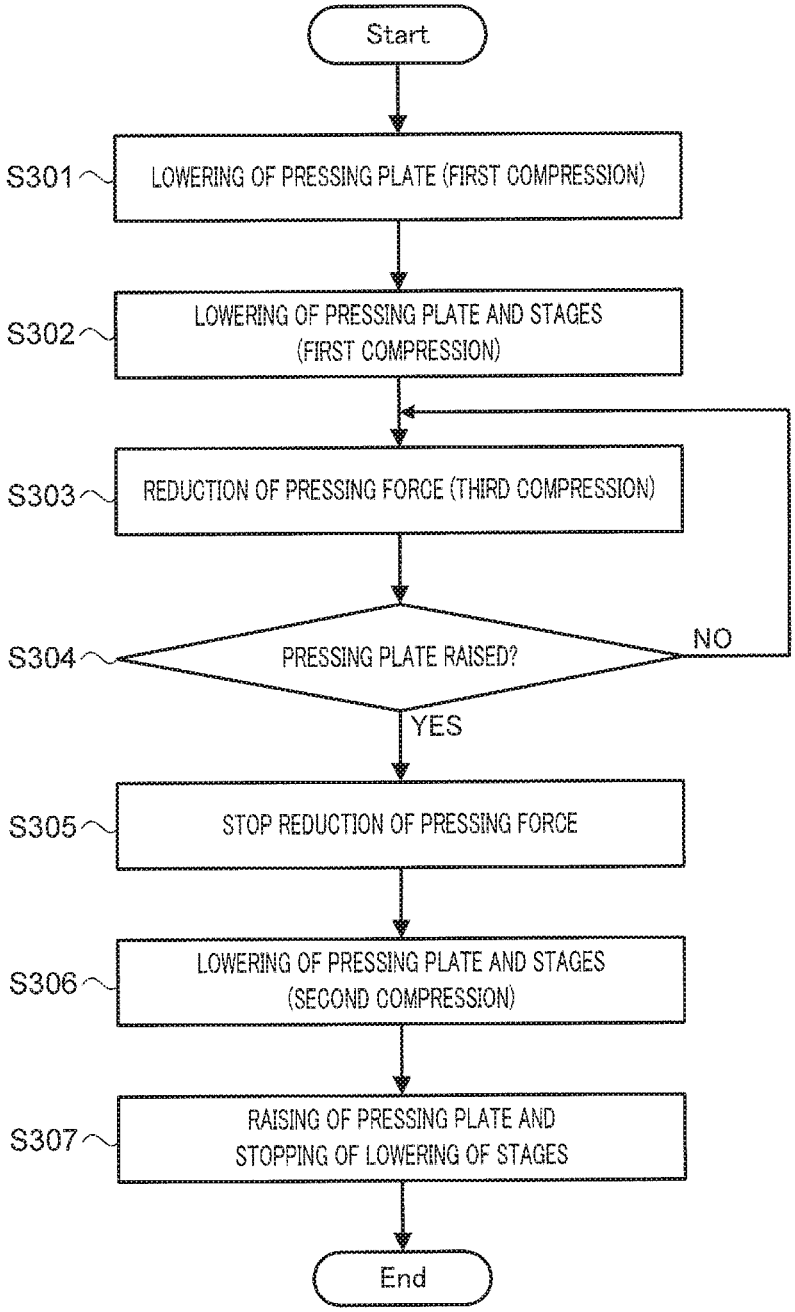
FIG. 15 is a flowchart illustrating operation of the banknote storing apparatus in mode 3.
Figure 16A:
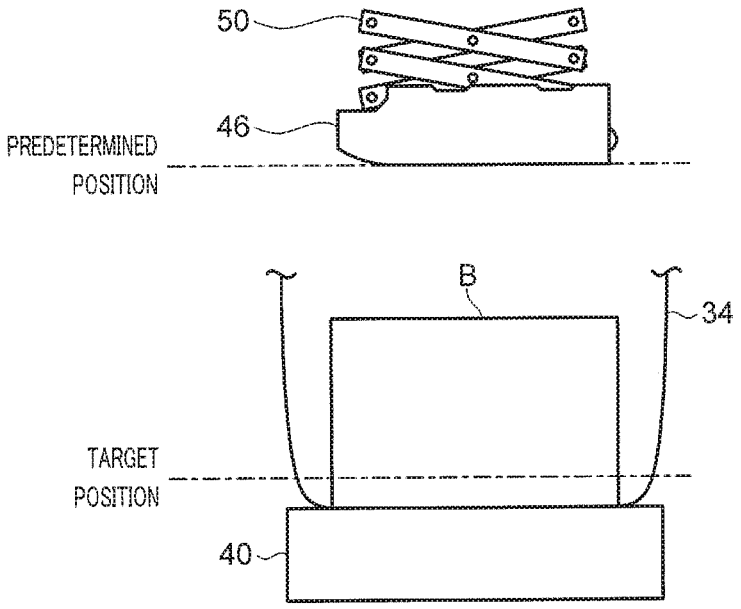
FIG. 16A is a schematic diagram illustrating operation of the banknote storing apparatus during execution of mode 3.

Next, mode 3, which is another operation mode for the banknote storing mechanisms 32, will be described. FIG. 15 is a flowchart illustrating operation of a banknote storing mechanism 32 in mode 3. FIG. 16A illustrates a state of the banknote storing mechanism 32 at a start of mode 3.

A state in which operation in mode 3 is started is the same as the state in which operation in mode 1 or mode 2 is started.

Upon a start of operation in mode 3, the pantograph 50 extended downward simultaneously with rotation of the temporary storing sections 44 (fall of a banknote bundle B) is further lowered and the pressing plate 46 is further lowered from a predetermined position (S301). After the pressing plate 46 comes in contact with an upper surface of the banknote bundle B, the pressing plate 46 is lowered until the pressing plate 46 reaches a predetermined height above a target position while the pressing plate 46 compresses the banknote bundle B.

Figure 16B:
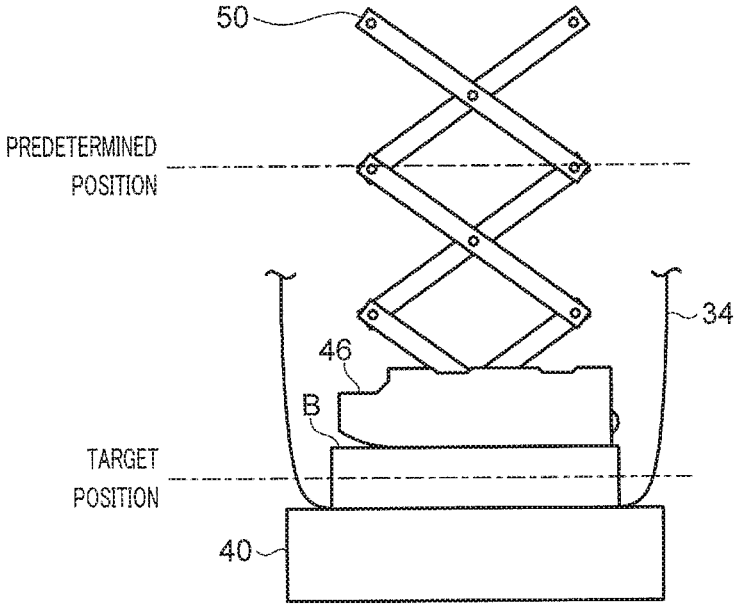
FIG. 16B is a schematic diagram illustrating operation of the banknote storing apparatus during execution of mode 3.

FIG. 16B illustrates a state in which the pressing plate 46 has reached the predetermined height above the target position. The predetermined height refers to a provisional stack height of a banknote bundle B that has fallen into the banknote storing bag 34 last where banknotes in the banknote bundle B are all brand-new banknotes.

In this step, the banknote bundle B is compressed vertically by the stages 40 that supports the banknote bundle B from below via the banknote storing bag 34 and the pressing plate 46 that applies a pressing force to the upper surface of the banknote bundle B (hereinafter, the pressing force applied at this time is referred to as "first pressing force" and the compression performed at this time is referred to as "first compression"). In other words, the stages 40 form a support section that supports the banknote bundle B from below via the banknote storing bag 34 and the pressing plate 46 is a pressing section that applies a pressing force to the upper surface of the banknote bundle B. Also, a compression section is made up of the stages 40 and the pressing plate 46.

Here, the pressing plate 46 reaching the predetermined height above the target position can be detected by a predetermined sensor that detects a position of the pressing plate 46. Also, the pressing plate 46 may be made to reach that position by actuating the relevant stepper motor 54 a predetermined number of steps calculated based on the provisional stack height of the last fallen banknote bundle B. Conversely, a position of a lower surface of the pressing plate 46 can be detected by detecting the number of steps, that is, operation of the stepper motor 54.

Figure 16C:
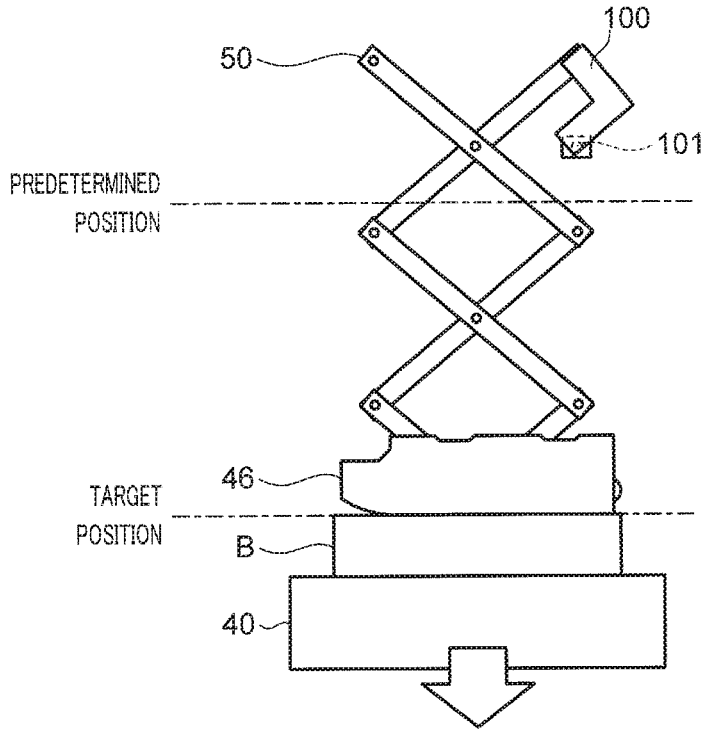
FIG. 16C is a schematic diagram illustrating operation of the banknote storing apparatus during execution of mode 3.

Subsequently, the pressing plate 46 and the stages 40 are lowered with a distance therebetween maintained, that is, together, until the lower surface of the pressing plate 46 reaches the target position. At this time, the first pressing force is continuously applied to the banknote bundle B. In other words, in a state in which the first compression is being performed, the pressing plate 46 and the stages 40 are lowered. FIG. 16C illustrates a state in which the lower surface of the pressing plate 46 has reached the target position.

Figure 16D:
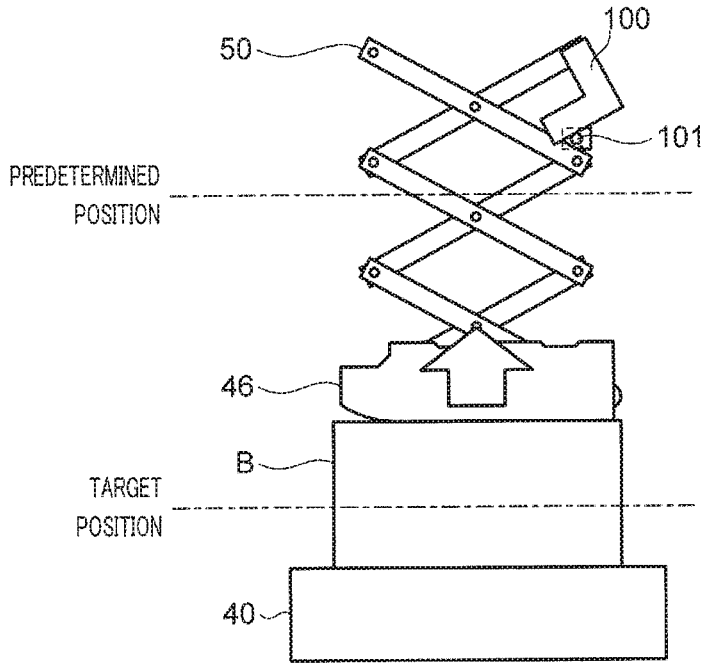
FIG. 16D is a schematic diagram illustrating operation of the banknote storing apparatus during execution of mode 3.
Figure 16E:
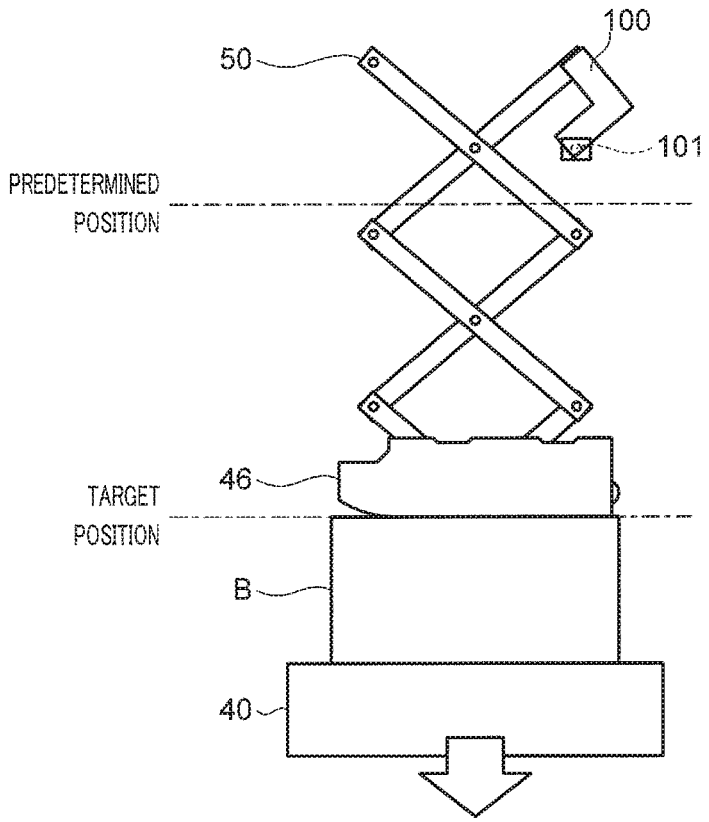
FIG. 16E is a schematic diagram illustrating operation of the banknote storing apparatus during execution of mode 3.
Figure 16F:
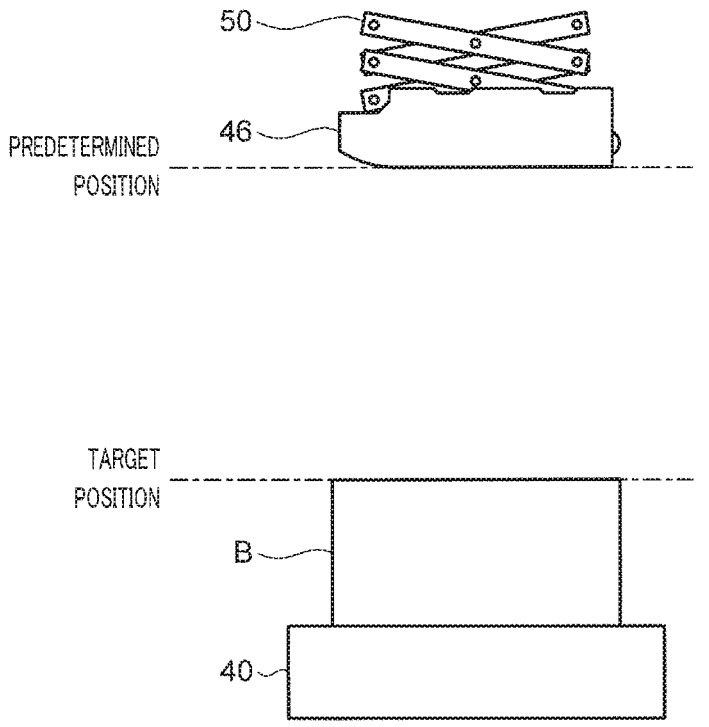
FIG. 16F is a schematic diagram illustrating operation of the banknote storing apparatus during execution of mode 3.

The lower surface of the pressing plate 46 reaching the target position is detected by the relevant target position detection sensor 101. The target position detection sensor 101 is a photo interrupter comprising a light-emitting element and a light-receiving element. The target position detection sensor 101 is mounted at a position where the relevant blocking plate 100 can first come between the light-emitting element and the light-receiving element when the pantograph 50 is extended downward until the lower surface of the pressing plate 46 reaches the target position. In other words, the target position detection sensor 101 is a sensor that detects a position of the blocking plate 100, that is, a position of a link member to which the blocking plate 100 is attached. In FIGS. 16A and 16B, and FIG. 16F referred to later, neither the blocking plate 100 nor the target position detection sensor 101 is illustrated for sake of convenience.

Upon the pantograph 50 being extended downward until the lower surface of the pressing plate 46 reaches the target position, the blocking plate 100 attached to the pantograph 50 comes between the light-emitting element and the light-receiving element. Then, the target position detection sensor 101 transmits a signal indicating that light is blocked, that is, a signal indicating that the lower surface of the pressing plate 46 has reached the target position (first signal) to the control section 80. Upon receipt of this signal, the control section 80 stops the lowering of the pressing plate 46 and the stages 40.

Next, the pressing force applied to the banknote bundle B by the pressing plate 46 is gradually reduced (S303). In this step, the banknote bundle B is pressed and compressed by a third pressing force. In other words, third compression is performed. In mode 3, the third pressing force is smaller than the first pressing force.

Here, increase/decrease of a value of a current flowing in the stepper motor 54 enables increasing/decreasing a driving force for driving the pantograph 50, and thus enables increasing/decreasing the pressing force applied to the banknote bundle B by the pressing plate 46.

When the banknote bundle B includes non-flat banknotes, the banknote bundle B assumes the character of an elastic body. In other words, the compressed banknote bundle B seeks to expand vertically and thus the upper surface of the banknote bundle B applies a reaction force to the lower surface of the pressing plate 46.

Therefore, the pressing force applied to the banknote bundle B by the pressing plate 46 is reduced, and upon the pressing force falling below the reaction force, the pressing plate 46 is raised upward by the reaction force. In other words, the pressing plate 46 is moved upward and the pantograph 50 is retracted upward. Therefore, the blocking plate 100 is moved upward from between the light-emitting element and the light-receiving element included in the target position detection sensor 101. FIG. 16D illustrates the state at this time.

Then, the target position detection sensor 101 transmits a signal indicating that the pressing plate 46 has been moved upward from the target position (second signal) to the control section 80. Upon receipt of this signal (YES in S304), the control section 80 stops the reduction of the pressing force applied to the banknote bundle B by the pressing plate 46 (S305). When the reduction of the pressing force is stopped, the pressing force applied to the banknote bundle B by the pressing plate 46 is a second pressing force. In mode 3, the second pressing force is smaller than the first pressing force and the third pressing force.

Until the second signal is received (during result of determination in S304 being NO), the reduction of the pressing force applied to the banknote bundle B by the pressing plate 46 is continued.

Subsequently, the pressing plate 46 and the stages 40 are lowered with the distance therebetween maintained, that is, in a unified manner until the lower surface of the pressing plate 46 reaches the target position (S306). At this time, the second pressing force is continuously applied to the banknote bundle B. In other words, in a state in which second compression is being performed, the pressing plate 46 and the stages 40 are lowered. FIG. 16E illustrates a state in which the lower surface of the pressing plate 46 has reached the target position. Here, the lower surface of the pressing plate 46 reaching the target position is detected by the target position detection sensor 101.

Upon the pressing plate 46 being lowered to the target position, the pressing plate 46 is raised and the stages 40 stops (S307). FIG. 16F illustrates a state in which the pressing plate 46 has been raised to the predetermined position. Operation of the banknote storing mechanism 32 in mode 3 is completed as above. After completion of mode 3, the pressing plate 46 is moved further above the predetermined position, and simultaneously, the pair of temporary storing sections 44 is rotated upward, and the pressing plate 46 and the pair of temporary storing sections 44 both enter the state illustrated in FIG. 2.

Execution of mode 3 enables an upper surface of a banknote bundle B stored inside a banknote storing bag 34 to be located at a target position. Therefore, even when non-flat banknotes that are likely to expand in a stacking direction are included in the banknote bundle B, sufficient space for storing a next banknote bundle B can be formed inside the banknote storing bag 34, more specifically, above the stored banknote bundle B. Therefore, a failure that the banknote storing bag 34 is overflowing with banknotes fallen from the temporary storing section 44 can be prevented. Therefore, when an opening of the banknote storing bag 34 is heat-sealed by heating members 38, it is possible to prevent a banknote from being stuck in a sealed part and thus prevent detective sealing.

In any of the modes, stacking of banknotes on the temporary storing sections 44 and storing of banknotes in a banknote storing bag 34 by the banknote storing mechanism 32 can be repeated until the banknote storing bag 34 becomes full or nearly full. The banknote storing bag 34 becoming full or nearly full is detected by the stage position detection sensor 79 detecting that the stages 40 have reached the lower end position.

Here, as described above, the torque sensor 59 is provided on a power transmission channel between the pressing plate 46 and the stepper motor 54, which is a power source for moving the pressing plate 46. The control section 80 consistently monitors a value of torque detected by the torque sensor 59, and the control section 80 can stop actuation of the stepper motor 54 when the torque, that is, the pressing force exceeds a predetermined value. Therefore, it is possible to prevent applying an excessive pressing force from the pressing plate 46 to the banknote bundle B as a result of excessive torque being generated on the power transmission channel, and thus prevent damaging the banknote storing mechanism 32, and/or the like.

The banknote storing apparatus 10 and the banknote processing method according to the present embodiment are not limited to the above-described mode, and various changes can be made.

For example, the lower surface of the pressing plate 46 reaching the target position or the lower surface being moved away from the target position may be detected by a predetermined sensor detecting a position of a member comprised in the pressing plate 46 such as the pressing part 46*a*. More specifically, for example, a position of the lower surface of the pressing plate 46 being located at the target position may be detected by a predetermined sensor detecting that the pressing part 46*a* has been moved upward relative to the base part 46*b*.

Alternatively, the lower surface of the pressing plate 46 reaching the target position or the lower surface being moved away from the target position may be detected by a predetermined sensor detecting a position of a member comprised in the pantograph 50 such as the link 50*a*.

Here, a sensor that detects the position of the lower surface of the pressing plate 46 is also referred to as "position detection section". For the position detection section, any of the following can be used: (1) a sensor that detects a position of a member comprised in the pantograph 50; (2) a sensor that detects a position of a member comprised in the pressing plate 46; (3) a sensor that detects operation of the stepper motor 54; (4) a combination of the sensor in (1) and the sensor in (2); (5) a combination of the sensor in (1) and the sensor in (3); (6) a combination of the sensor in (2) and the sensor in (3); and (7) a combination of the sensor in (1), the sensor in (2) above and the sensor in (3).

Also, when the banknote bundle B includes non-flat banknotes and the banknote bundle B is compressed by the stages 40 and the pressing plate 46, as a relative distance between the stages 40 and the base part 46*b* increases, a stack thickness of the banknote bundle B increases until the banknote bundle B completely expands. Therefore, in this case, even when the relative distance between the stages 40 and the pressing plate 46 is increased until the banknote bundle B completely expands, a position of the pressing part 46*a* relative to the base part 46*b* does not change. Using such characteristic, it is possible to detect that the banknote bundle B has completely expanded. In other words, the lower surface of the pressing part 46*a* being located at a position at which the lower surface is in contact with the upper surface of the banknote bundle B without pressing the banknote bundle B may be detected by a predetermined sensor detecting that the pressing part 46*a* has been moved downward relative to the base part 46*b*.

Also, control of a pressing force applied to the banknote bundle B may be performed based on a reaction force applied from the banknote bundle B to the compression section. The reaction force can be detected by a pressure sensor provided on the pressing plate 46 or the stages 40.

Also, the banknote storing mechanism 32 may comprise a thickness detection section that detects a stack thickness of a banknote bundle B stacked in the banknote storing bag 34. For the thickness detection section, for example, an ultrasound or optical level sensor can be used. The control section 80 can detect that the banknote storing bag 34 is full or nearly full or that the upper surface of the banknote bundle B has reached the target position, based on the stack thickness of the banknote bundle B detected by the thickness detection section and the position of the stages 40.

Also, the banknote bundle B stored inside the banknote storing bag 34 may be stacked not just vertically but transversely, for example, horizontally. In this case, a compression section is made up of a stopper member (corresponds to the support section) disposed on one side in the horizontal direction, the stopper member comprising a vertical surface, and a pressing member disposed on the other side in the horizontal direction (corresponding to the pressing section). Also, the banknote storing bag 34 is disposed, with an opening portion facing in the transverse direction, between the stopper member and the pressing member.

Also, the control in each of mode 1, mode 2 and mode 3 may not be performed until an amount of banknotes stored in the banknote storing bag 34 becomes equal to or exceeds a predetermined threshold value, that is, until the banknote storing bag 34 becomes full or nearly full.

In this case, for example, the following control is performed. First, a value indicating an amount of banknotes stored in the banknote storing bag 34 is detected. For this value, for example, the number of banknotes, a total amount of the banknotes or a total sum of amounts of lowering of the stages, which have been calculated by the control section 80 or a stage position detected by the stage position detection sensor 79 may be used.

When such value is smaller than a predetermined threshold value, that is, an amount of banknotes stored in the banknote storing bag 34 is small, the control section 80 first causes the pressing plate 46 to be lowered with the stages 40 stopped. In other words, a pressing force is applied to the banknote bundle B and the banknote bundle B is thereby compressed. Subsequently, the control section 80 causes the stages 40 and the pressing plate 46 to be lowered a predetermined distance with the relative distance between the stages 40 and the pressing plate 46 kept constant. Upon the stages 40 and the pressing plate 46 being lowered the predetermined distance, the control section 80 stops the lowering of the stages 40 and the pressing plate 46. Subsequently, the control section 80 causes the pressing plate 46 to be raised with the stages 40 stopped. In other words, the control section 80 causes the banknote bundle B to be compressed just once.

Also, when the value indicating the amount of banknotes stored in the banknote storing bag 34 is equal to or exceeds the predetermined threshold value, the control section 80 performs the above-described control in mode 1, mode 2 or mode 3. In other words, the control section 80 causes the banknote bundle B to be compressed a plurality of times.

Performing such control provide the following advantages.

When the amount of banknotes stored in the banknote storing bag 34 is small, the position of the stages 40 is high, and thus even when an upper portion of the banknote bundle B is at the same level as a part to be heat-sealed, heat-sealing is not performed yet. Therefore, there is no need to strictly manage a position of the upper portion of the banknote bundle B. Thus, with such control as above, when the amount of banknotes stored is small, compression of the banknote bundle B is performed more quickly, enabling a next banknote bundle B to fall into the banknote storing bag 34 in a shorter span. In other words, banknote storing processing can quickly be performed.

Also, when the amount of banknotes stored in the banknote storing bag 34 becomes large, the stored banknote bundle B is more reliably compressed, and even when the banknote bundle B includes non-flat banknotes, it is possible to prevent interference of the upper portion of the banknote bundle B with a heat-sealed portion and thereby prevent defective sealing.

It should be understood that sheets stored in a sheet storing apparatus according to the present invention do not necessarily need to be banknotes and may be sheets such as checks or gift certificates. In other words, a sheet storing apparatus according to the present invention is not limited to a banknote storing apparatus and may be one that stores sheets other than banknotes.

INDUSTRIAL APPLICABILITY

The present invention is suitable for use as a sheet storing apparatus and a sheet storing method.

REFERENCE SIGNS LIST

10 banknote storing apparatus
12 casing
14 upper unit
16 lower unit
20 inlet
20*a* banknote feeding mechanism
22 outlet
22*a* stacking wheel
22*b* stacking wheel driving section
24 transport unit
25 diverged transport unit
26 recognition unit
30 storing/feeding unit
30*a* drum
31 tape
32 banknote storing mechanism
34 banknote storing bag
34*a* projection portion
34*b* hole
34*c* reinforcement member
36 holding member
36*a* pin
36*b* surface
36*p* guide pin
36*k* frame body
36*q* long hole
37 slide mechanism
38 heating member
39 biasing lever
39*a* biasing lever driving section
40 stage
40*a* hinge portion
41 stage driving section
42 heating member
44 temporary storing section
44*a*, 46*c*, 51 shaft
45, 55, 56, 57, 64 gear
46 pressing plate
46*a* pressing part
46*b* base part
46*d* detection target member
46*e* attachment member
46*f* guide hole
46*g* pin member
47 temporary storage amount detection sensor
48 banknote feeding section
50 pantograph
50*a*, 50*b*, 50*c*, 50*d*, 50*e*, 50*f* link
52 rack
54 stepper motor
58, 62 pulley
59 torque sensor
60 circulating belt
66 rotating shaft
70 cam
72 power transmission member
72*a* teeth part
75 detection target plate
76 upper end detection sensor
78 lower end detection sensor
79 stage position detection sensor
79*a* first sensor
79*b* second sensor
80 control section
82 operation/display unit
84 storage section
86 printing section
88 communication interface section
89 external apparatus
100 blocking plate
101 target position detection sensor
B banknote bundle

The invention claimed is:

1. A sheet storing apparatus for storing sheets in a bag, comprising:

a holding member configured to hold the bag;

a storage mechanism configured to store sheets in the bag held by the holding member;

a stage on which the bag held by the holding member is placed, the stage configured to move in a first direction and in a second direction opposite to the first direction;

a pressing member configured to apply pressing force to the sheets stored in the held bag which is placed on the stage and to move in the first direction in which the pressing member moves from a first position toward the stage and the second direction in which the pressing member moves away from the stage; and a controller configured to control the apparatus such that the pressing member performs first compression in which the pressing member applies first pressing force to the sheets stored in the held bag and thereafter second compression in which the pressing member applies second pressing force that is smaller than the first pressing force to the sheets stored in the held bag, wherein the controller is configured to control the apparatus such that the pressing member performs the first compression when the pressing member moves in the first direction from the first position to a second position toward the stage at a third position and reaches the second position, and thereafter the pressing member performs the second compression while the pressing member moves in the first direction from the second position to a fourth position by a first distance and the stage moves in the first direction from the third position to a fifth position by a second distance that is larger than the first distance.

2. The sheet storing apparatus according to claim 1, wherein the pressing member is configured to perform third compression between the first compression and the second compression, the third compression in which third pressing force that is smaller than the first pressing force but is larger than the second pressing force is applied to the sheets.

3. The sheet storing apparatus according to claim 1, wherein the pressing member is configured to perform third compression between the first compression and the second compression, the third compression in which third pressing force that is smaller than the second pressing force is applied to the sheets.

4. The sheet storing apparatus according to claim 1, wherein the controller is configured to control the apparatus such that the pressing member moves in the second direction from the fourth position to the first position while the stage stops at the fifth position after the second compression is performed.

5. The sheet storing apparatus according to claim 1, further comprising a position detection sensor configured to detect a position of a predetermined portion of the pressing member and output a first signal when the predetermined portion of the pressing member is located at the fourth position.

6. The sheet storing apparatus according to claim 5, wherein the position detection sensor is configured to output a second signal when the predetermined portion of the pressing member is located between the first position and the fourth position.

7. The sheet storing apparatus according to claim 6, further comprising a driving mechanism configured to move the pressing member toward and away from the stage, wherein the controller is configured to adjust the pressing force by the controller controlling the driving mechanism.

8. The sheet storing apparatus according to claim 6, wherein the controller is configured to control the apparatus such that the stage and the pressing member move in the first direction until the controller receives the first signal, and after reception of the first signal, the pressing force is reduced until the controller receives the second signal, and after reception of the second signal, the stage and the pressing member move in the first direction maintaining a constant distance between the stage and the pressing member, until the controller receives the first signal again.

9. The sheet storing apparatus according to claim 1, further comprising an amount detection sensor configured to detect an amount of the sheets stored in the bag, wherein:

the controller is configured to control the apparatus such that the pressing member moves in the first direction while the stage stops at the third position, to apply the pressing force to the sheets, subsequently, the stage and the pressing member move in the first direction by a predetermined distance maintaining a constant distance between the stage and the pressing member, and subsequently, the pressing member moves in the second direction while the stage stops the fifth position when the amount detected by the amount detection sensor is smaller than a predetermined threshold value, and to control the pressing member so as to perform the first compression and the second compression when the amount detected by the amount detection sensor is equal to or larger than the predetermined threshold value.

10. The sheet storing apparatus according to claim 1, further comprising a reaction force detection sensor section configured to detect a reaction force applied from the sheets to the pressing member, wherein the controller is configured to control the pressing force based on the detected reaction force.

11. The sheet storing apparatus according to claim 10, further comprising a thickness detection sensor section configured to detect a thickness of the sheets stacked in the bag.

12. The sheet storing apparatus according to claim 1, wherein the first direction is a downward direction and the second direction is an upward direction.

13. The sheet storing apparatus according to claim 1, wherein the controller is configured to control the pressing member to the pressing member stops at the fourth position when the pressing member section reaches the fourth position.

14. The sheet storing apparatus according to claim 1 6, wherein the controller is configured to control the pressing member such that the pressing member moves in the second direction after the pressing member reaches the fourth position.

15. The sheet storing apparatus according to claim 1 6, wherein the controller is configured to control the pressing member and stage such that cause the pressing member reaches the fourth position and stops at the fourth position and the stage stops after the stage moves by the second distance.

* * * * *